US007821211B2

(12) United States Patent
Nagumo

(10) Patent No.: US 7,821,211 B2
(45) Date of Patent: Oct. 26, 2010

(54) DRIVE CIRCUIT, LIGHT EMITTING DIODE HEAD, AND IMAGE FORMING APPARATUS

(75) Inventor: Akira Nagumo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 147 days.

(21) Appl. No.: 12/222,983

(22) Filed: Aug. 21, 2008

(65) Prior Publication Data

US 2009/0066374 A1 Mar. 12, 2009

(30) Foreign Application Priority Data

Sep. 10, 2007 (JP) ..... 2007-233955

(51) Int. Cl.
*H05B 37/00* (2006.01)

(52) U.S. Cl. ..... 315/291; 315/169.3; 315/307; 315/308

(58) Field of Classification Search ..... 315/291, 315/307, 308, 169.3
See application file for complete search history.

(56) References Cited

FOREIGN PATENT DOCUMENTS

| | | |
|---|---|---|
| JP | 63-250873 | 10/1988 |
| JP | 02-096428 | 4/1990 |
| JP | 2000-221545 | 8/2000 |
| JP | 2001-358570 | 12/2001 |
| JP | 2002-283914 | 10/2002 |
| JP | 2006-101490 | 4/2006 |

*Primary Examiner*—David Hung Vu
(74) *Attorney, Agent, or Firm*—Kubotera & Associates LLC

(57) ABSTRACT

A drive circuit is provided for selectively driving a driven element. The drive circuit includes a discharge section for discharging charges, which are accumulated in the driven element when the drive element is turned on, when the drive element is turned off. The drive circuit may include a drive element for driving the driven element. The drive element includes a first ground route disposed separately from a second ground route of the driven element. The first ground route is connected to the second ground route through a connection cable. A diode may be disposed between the connection cable and at least one of the first ground route and the second ground route.

22 Claims, 16 Drawing Sheets

DRIVE CIRCUIT, LIGHT EMITTING DIODE HEAD, AND IMAGE FORMING APPARATUS

BACKGROUND OF THE INVENTION AND RELATED ART STATEMENT

The present invention relates to a drive circuit for driving a group of driven elements such as, for example, an array of light emitting diodes (LEDs) disposed in an electro-photography printer as a light source, an array of heating resistors disposed in a thermal printer, and an array of display units disposed in a display device. The present invention also relates to a light emitting diode (LED) head including the drive circuit; and an image forming apparatus including the light emitting diode (LED) head.

In the specification, a light emitting diode may be referred to as an LED; a monolithic integrated circuit may be referred to as an IC; an n-channel MOS (Metal Oxide Semiconductor) transistor may be referred to as an NMOS (transistor); and a p-channel MOS transistor may be referred to as a PMOS (transistor).

Further, a high signal level may be referred to as a logical value of one (1), and a low signal level may be referred to as a logical value of zero (0), regardless of a positive logic or a negative logic. When it is necessary to differentiate the positive logic and the negative logic in a logical signal, "–P" may be added to an end of a positive logical signal, and "–N" may be added to an end of a negative logical signal.

In the following description, a group of driven elements is an array of LEDs used in an electro-photography printer as an example.

In a conventional electro-photography printer, a light source selectively irradiates a photosensitive drum charged according to print information, thereby forming a static latent image on the photosensitive drum. Then, toner is attached to the static latent image to form a toner image. Afterward, the toner image is transferred to a sheet, so that the toner image is fixed to the sheet. The light source may be formed of LEDs.

In the conventional electro-photography printer, an LED head is formed of an LED array chip and a driver IC for driving the LED array chip.

The LED head includes a reference voltage generation circuit for generating a reference voltage, so that a drive current for driving LED elements is determined based on the reference voltage generated from the reference voltage generation circuit and a resistor disposed in the driver IC. The resistor is produced through a semiconductor process technology. In general, the resistor is formed of poly-silicon or an impurity diffused resistor, and is integrated in the driver IC in a form of monolithic.

FIG. 13 is a block diagram showing an LED head 19 and a print control unit 1 of the conventional electro-photography printer. As shown in FIG. 13, the electro-photography printer includes the print control unit 1; the LED head 19; and a connection cable 47 connecting the print control unit 1 and the LED head 19. The print control unit 1 is formed of a microprocessor, an RAM, an ROM, an input-output port, a timer, and the likes. The print control unit 1 is disposed in a printing unit of the electro-photography printer for controlling a printing operation according to a control signal from an upper controller.

In the conventional electro-photography printer, the print control unit 1 is usually arranged away from the LED head 19. Accordingly, it is necessary to connect the print control unit 1 and the LED head 19 with the connection cable 47 having a large cable length. In general, the connection cable 47 has a cable length of about 50 cm. When the conventional electro-photography printer is a tandem type color printer having a plurality of photosensitive drums arranged in parallel, the connection cable 47 tends to have a cable length of more than 1 m, thereby causing a problem (described later).

In the following description, as an example, the LED head 19 is capable of printing on a sheet with A-4 size at a resolution of 600 dots per one inch. In this case, the LED head 19 includes a total of 4992 dots of the LED elements. More specifically, the LED head 19 includes 26 of LED arrays, and each LED array is formed of 192 of the LED elements.

As shown in FIG. 13, the LED head 19 includes LED arrays CHP1 and CHP26, and LED arrays CHP3 to CHP24 are omitted in FIG. 3. Driver ICs IC1 and IC 26 are arranged to correspond to the LED arrays CHP1 and CHP26 for driving the LED arrays CHP1 and CHP26, respectively. The driver ICs IC1 and IC 26 are formed of an identical circuit, and adjacent driver ICs are connected in a cascade connection.

The LED array CHP1 includes LED elements LED1 to LED192, so that 192 of the LED elements are arranged per each LED array. Accordingly, the LED array CHP25 includes LED elements LED4609 to LED4800, and the LED array CHP26 includes LED elements LED4801 to LED4992.

In the LED head 19 shown in FIG. 13, 26 of the LED arrays (CHP1 to CHP26) and 26 of the driver ICs (IC1 to IC26) for driving the LED arrays are arranged on a print circuit board (not shown) to face each other. One chip of the driver IC is capable of driving 192 of the LED elements, and 26 chips of the driver ICs are connected in a cascade connection for transmitting in serial print data input from outside.

The LED head shown in FIG. 13 is formed of a semiconductor compound such as GaAsP and AlGaAs, and a forward voltage of each LED is about 1.6 V upon driving.

In the LED head 19 shown in FIG. 13, each of the driver ICs (IC1 to IC26) is formed of an identical circuit, and adjacent driver ICs are connected in a cascade connection. Each of the driver ICs includes a shift resister circuit 44 for receiving a clock signal HD-CLK and performing shift transfer of print data; a latch circuit 43 for latching an output signal of the shift resister circuit 44 according to a latch signal (referred to as HD-LOAD); an AND circuit 42 for receiving outputs of the latch circuit 43 and an inverter circuit 41 to obtain a logic product; an LED drive circuit 40 for supplying a drive current from a power source VDD to the LED element (CHP1 etc.) according to an output signal of the AND circuit 42; and a control voltage generation circuit 45 for generating a control voltage such that the drive current of the LED drive circuit 40 becomes constant.

A strobe signal HD-STB-N is input to the inverter circuit 41. Further, a reference voltage generation circuit 46 is provided, in which a power source terminal thereof is connected to the power source VDD, a ground terminal thereof is connected to the LED head 19, and an output terminal thereof is connected to the control voltage generation circuit 45 of each of the driver ICS IC1 to IC26 for supplying a reference voltage Vref.

Note that the print control unit 1 sends the print data signal HD-DATA, the clock signal HD-CLK, the latch signal HD-LOAD, and the strobe signal HD-STB-N. The connection cable 47 include cables of the control signals (the print data signal HD-DATA, the clock signal HD-CLK, the latch signal HD-LOAD, and the strobe signal HD-STB-N), the power source VDD, and a ground VSS.

FIG. 14 is a circuit diagram showing an LED drive circuit of the driver IC in the LED head 19 of the conventional electro-photography printer. FIG. 14 shows a connection relationship of the LED drive circuit and a peripheral portion thereof, and dot 1 (a peripheral portion the drive circuit of the LED 1) is shown as an example. In FIG. 14, an area 71 surrounded with a hidden line represents the driver IC, and an area 72 corresponds to the LED array.

As shown in FIG. 14, the LED drive circuit includes the inverter circuit 41 shown in FIG. 13, an AND circuit 42, and a latch circuit 51 corresponding to one element of the latch circuit 43 shown in FIG. 13. The latch circuit 51 has a input terminal D connected to an output terminal of a shift register (not shown, corresponding to the shift resister circuit 44 in FIG. 13); an input terminal G connected to the latch signal HD-LOAD; and an output terminal Q connected to one of input terminals of the AND circuit 42.

The inverter circuit 52 is formed of a PMOS transistor 53 and an NMOS transistor 54. A source terminal of the PMOS transistor 53 is connected to the power source VDD. Drain terminals and gate terminals of the PMOS transistor 53 and the NMOS transistor 54 are connected to with each other. A source terminal of the NMOS transistor 54 is connected to an output terminal of an operational amplifier 61 (described later), so that a potential Vcont is applied to the source terminal of the NMOS transistor 54.

A PMOS transistor 55 is also provided. A gate terminal of the PMOS transistor 55 is connected to the drain terminals of the PMOS transistor 53 and the NMOS transistor 54. The LED element LED1 is also provided.

The operational amplifier 61 has an output voltage as the potential Vcont. A resistor 63 has a resistivity of Rref. A PMOS transistor 62 has a gate length same as that of the PMOS transistor 55. The reference voltage generation circuit 46 shown in FIG. 13 generates the reference voltage Vref connected to an inverse input terminal of the operational amplifier 61.

A source terminal of the PMOS transistor 62 is connected to the ground, a gate terminal thereof is connected to the output terminal of the operational amplifier 61, and a drain terminal thereof is connected to one end portion of the resistor 63 and a non-reverse input terminal of the operational amplifier 61. A feedback circuit is formed of the operational amplifier 61, the PMOS transistor 62, and the resistor 63, so that a current flowing through the resistor 63, that is, a current flowing through the PMOS transistor 62, is determined only by the reference voltage Vref and the resistivity Rref of the resistor 63 regardless of a power voltage of the power source VDD.

When the NMOS transistor 54 is turned on, the PMOS transistor 53 becomes an off state. The PMOS transistor 55 has a gate potential same as that of the Vcont potential. Accordingly, the PMOS transistor 55 has a gate-source voltage same as that of the PMOS transistor 62, thereby constituting a current-mirror relationship. As a result, it is possible to adjust the drain current of the PMOS transistor 55 according to the reference voltage Vref, thereby controlling the drive current of the LED element in the LED array 72 at a specific level.

FIG. 15 is a circuit diagram showing the LED drive circuit and the print control unit 1 of the conventional electro-photography printer. In FIG. 15, the output signals and the likes inside the print control unit 1 are omitted, and only the power source VDD is shown. In the connection cable 47, the control signals and the likes are omitted, and only the power source VDD and the ground VSS are shown. The ground VSS has a resistivity of Rg. As shown in FIG. 15, in the conventional electro-photography printer, the LED array 72 includes a ground route shared with that of the driver IC 71.

Patent Reference has disclosed a method of driving an LED element. In Patent Reference, only a principle of the method of driving the LED element has been shown, and no specific circuit diagram has been disclosed. FIGS. 16(*a*) to 16(*c*) are circuit diagrams showing the method of driving the LED element. Note that FIG. 16(*a*) is an equivalent circuit diagram showing a first drive circuit and corresponding to the circuit diagram shown in FIG. 14.

Patent Reference: Japanese Patent Publication No. 08-4153

As shown in FIGS. 16(*a*) to 16(*c*), the drive circuit includes a constant current source 81, an LED 82, and a capacity 83, i.e., a model of a junction capacity between an anode terminal and a cathode terminal of the LED 82 and a floating capacity of a wiring. When a switch unit 84 is turned to a side A, the LED 82 is turned off, and when the switch unit 84 is turned to a side B, the LED 82 is turned on.

When the switch unit 84 is turned to the side B and the LED 82 is turned on, a forward voltage VF of the LED 82 (in this case, about 1.6 V) is applied to a capacity Cj between the anode terminal and the cathode terminal of the LED 82.

When the switch unit 84 is switched from the side B to the side A to turn off the LED 82, the drive current from the constant current source 81 is disconnected immediately after the switch unit 84 is switched. Charges accumulated in the capacity Cj are discharged slowly in a forward direction of the LED 82, thereby increasing a switching time.

FIG. 16(*b*) is an equivalent circuit diagram showing a second drive circuit. In the equivalent circuit diagram shown in FIG. 16(*b*), when he switch unit 84 is turned to the side B to turn on the LED 82, an operation thereof is the same as that in the first drive circuit shown in FIG. 16(*a*). When he switch unit 84 is turned to the side A to turn off the LED 82, the anode terminal and the cathode terminal of the LED 82 are short-circuited, thereby discharging charges accumulated in the capacity Cj.

FIG. 16(*c*) is an equivalent circuit diagram showing a third drive circuit. In the equivalent circuit diagram shown in FIG. 16(*c*), when he switch unit 84 is turned to the side B to turn on the LED 82, an operation thereof is the same as that in the first drive circuit shown in FIG. 16(*a*). When he switch unit 84 is turned to the side A to turn off the LED 82, a voltage V is applied between the anode terminal and the cathode terminal of the LED 82. In this case, it is set such that the voltage V is smaller than the forward voltage VF of the LED 82. Accordingly, while charges accumulated in the capacity Cj between the anode terminal and the cathode terminal of the LED 82 are rapidly discharged below the forward voltage VF, the voltage does not become zero and is maintained at the voltage V for a next operation.

FIG. 17 is a graph showing drive waves of the LED drive circuits shown in FIGS. 16(*a*) to 16(*c*) of the conventional electro-photography printer. As shown in FIG. 17, the strobe signal HD-STB-N (negative logic) sent to the LED head 19 shown in FIG. 13 shows changes of the LED from the off state to the on state, and then from the on state to the off state.

FIG. 17 shows a voltage Vo between the anode terminal and the cathode terminal of the LED 82 and a luminescent output Po of the LED. When the LED is turned on, the voltage Vo becomes a voltage Vf. The voltage Vo changes differently when the LED is turned off according to the LED drive circuits shown in FIGS. 16(*a*) to 16(*c*).

In the LED drive circuit shown in FIGS. 16(*a*), the voltage Vo changes along a hidden line decreasing gradually accompanied with the capacity Cj discharging gradually. In the LED drive circuit shown in FIG. 16(*b*), the voltage Vo changes along a solid line. That is, the voltage Vo becomes zero immediately after the strobe signal HD-STB-N is turned off, and the luminescent output Po decreases rapidly as indicated with a solid line.

In the LED drive circuit shown in FIG. 16(*c*), the voltage Vo is maintained at the voltage V along a projected line. As described above, it is set such that the voltage V is smaller than the forward voltage VF of the LED, thereby flowing no drive current. Further, when the LED is turned on, the voltage Vo changes from the voltage V, so that the luminescent output Po increases in a shorter period of time. When the LED is turned off, similar to the second drive circuit shown in FIG. 16(*b*), the luminescent output Po decreases rapidly as indicated with the solid line.

Accordingly, in the third drive circuit shown in FIG. 16(*c*), the luminescent output Po increases and decreases more rapidly than the first and second drive circuits shown in FIG. 16(*a*) and FIG. 16(*b*), thereby increasing an operational speed.

In the LED drive circuit of the conventional electro-photography printer shown in FIG. 14, it is difficult to increase the luminescent output in a short period of time, thereby making a fast switching operation difficult. The LED drive circuit of the conventional electro-photography printer shown in FIG. 14 corresponds to the LED drive circuit shown in FIG. 16(*a*). When the LED is turned on, the drive current is supplied to the drive circuit, and when the LED is turned off, the drive current is disconnected to be in an open state.

Accordingly, immediately after the LED is turned on, a remaining voltage is generated due to charges accumulated in the capacity between the anode terminal and the cathode terminal of the LED. As a result, the discharge current continues to flow through the LED, thereby slowing a response of the LED.

In view of the problems described above, an object of the present invention is to provide a drive circuit capable of solving the problems of the conventional drive circuit. In the drive circuit, it is possible to achieve a fast response of a luminescent output of an LED when the LED is turned off, thereby obtaining a fast operation of the drive circuit and an LED head.

Further objects and advantages of the invention will be apparent from the following description of the invention.

SUMMARY OF THE INVENTION

In order to attain the objects described above, according to the present invention, a drive circuit is provided for selectively driving a driven element. The drive circuit includes a discharge section for discharging charges, which are accumulated in the driven element when the drive element is turned on, when the drive element is turned off.

According to the present invention, the drive circuit may include a drive element for driving the driven element. The drive element includes a first ground route disposed separately from a second ground route of the driven element. The first ground route is connected to the second ground route through a connection cable. A diode may be disposed between the connection cable and at least one of the first ground route and the second ground route.

According to the present invention, an LED (Light Emitting Diode) head includes a drive circuit for selectively driving a light emitting diode as a driven element. The drive circuit includes a discharge section for discharging charges when the drive element is turned off in the driven element accumulated when the drive element is turned on.

According to the present invention, an image forming apparatus includes a drive circuit for selectively driving a driven element. The drive circuit includes a discharge section for discharging charges when the drive element is turned off in the driven element accumulated when the drive element is turned on.

In the present invention, it is possible to turn off the driven element in a short period of time, thereby obtaining a fast operation of the LED head and the image forming apparatus using the driven element.

DETAILED DESCRIPTION OF PREFERRED EMBODIMENTS

Figure 1:
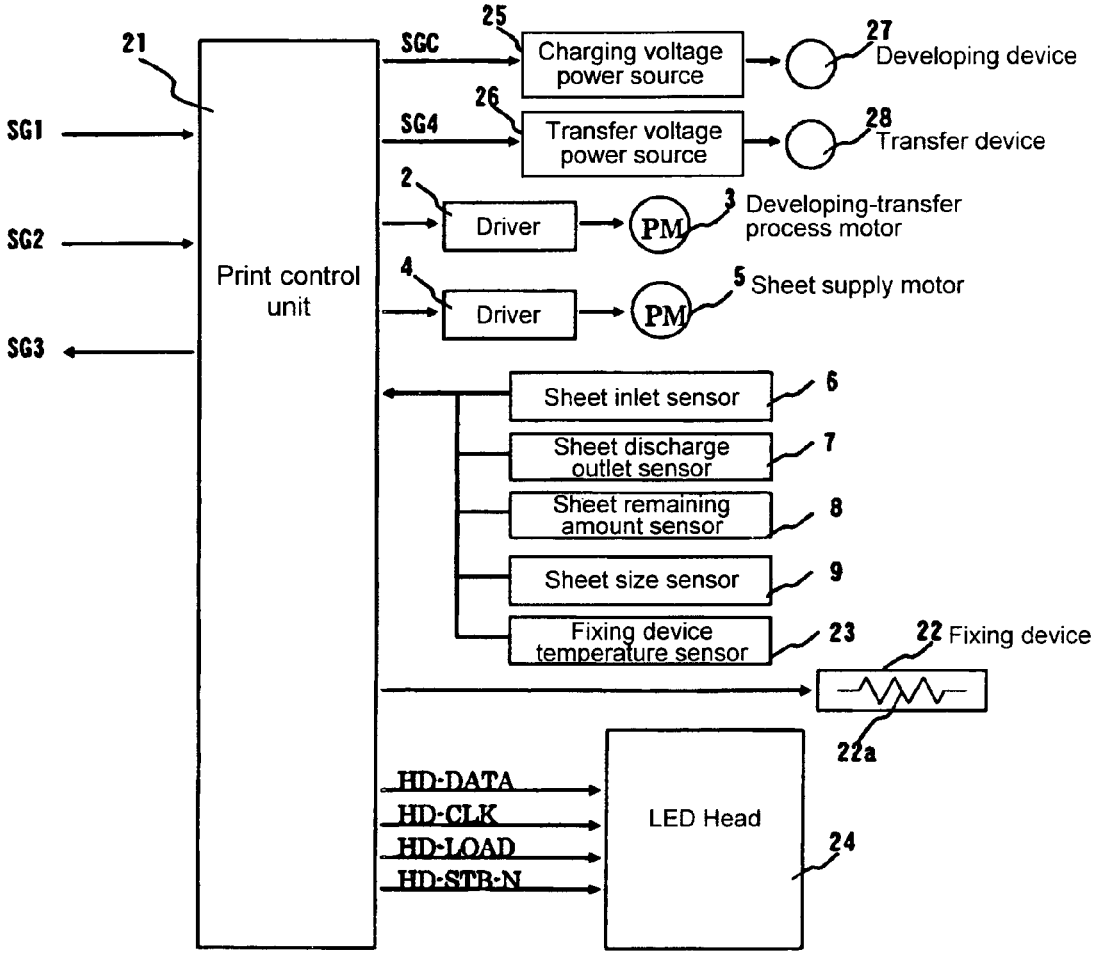
FIG. 1 is a block diagram showing a configuration of an electro-photography printer according to a first embodiment of the present invention.

Hereunder, preferred embodiments of the present invention will be explained with reference to the accompanying drawings. Similar components in the drawings are designated with the same reference numerals.

First Embodiment

Figure 2:
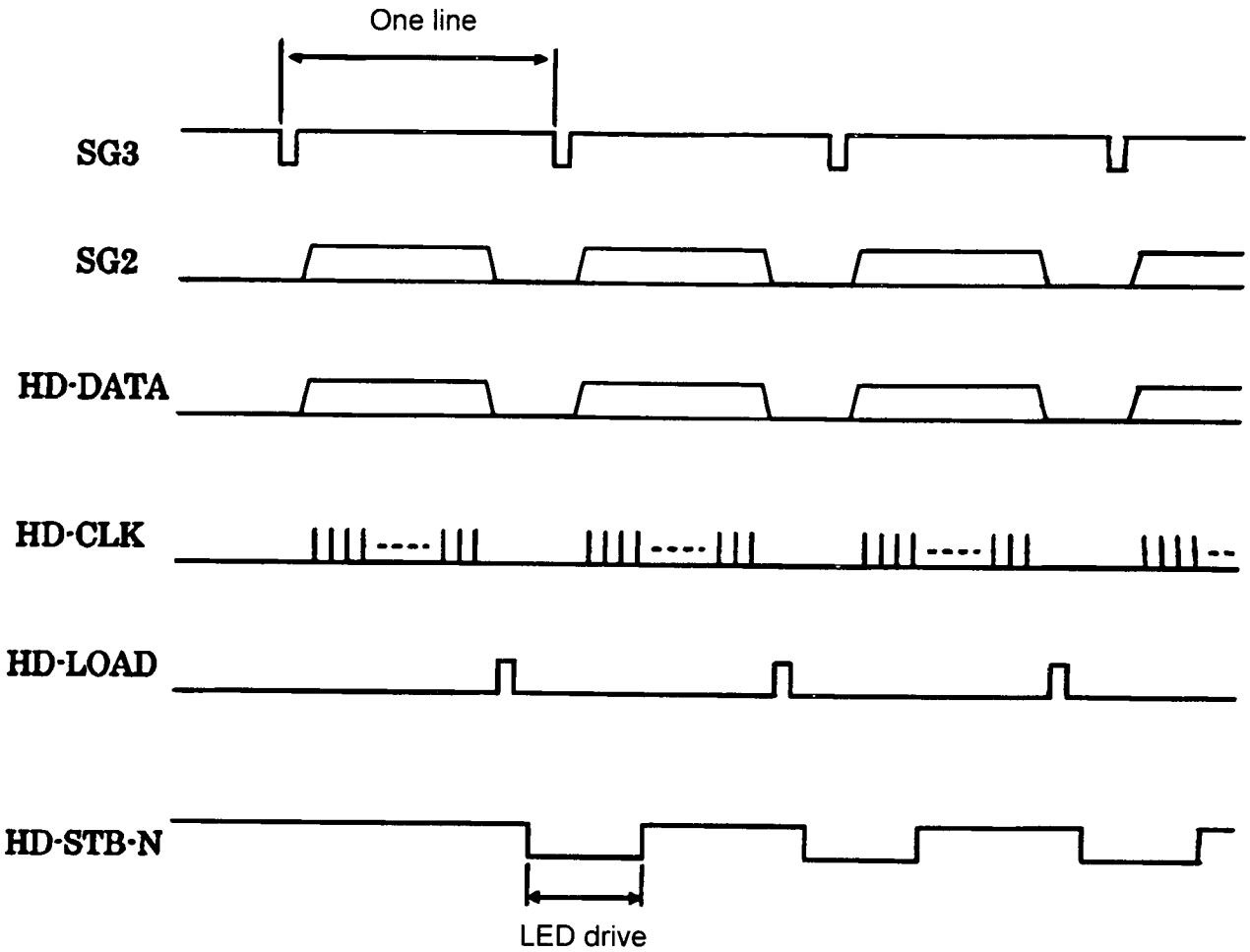
FIG. 2 is a time chart showing an operation of the electro-photography printer according to the first embodiment of the present invention.

A first embodiment of the present invention will be explained. FIG. 1 is a block diagram showing a configuration of an electro-photography printer according to a first embodiment of the present invention. FIG. 2 is a time chart showing an operation of the electro-photography printer according to the first embodiment of the present invention.

As shown in FIG. 1, the electro-photography printer includes a print control unit 21 formed of a microprocessor, an RAM, an ROM, an input-output port, a timer, and the likes. The print control unit 21 is disposed in a printing unit of the electro-photography printer for performing a sequence control of an entire portion of the electro-photography printer and a printing operation according to a control signal SG1, a video signal SG2 (in which dot map data are arranged one-dimensionally), and the likes from an upper controller (not shown).

When the print control unit 21 receives a print direction along with the control signal SG1, the print control unit 21 first detects whether a fixing device 22 with a heater 22*a* disposed therein is within an operatable temperature range using a fixing device temperature sensor 23. When the fixing device 22 is not within the operatable temperature range, the print control unit 21 energizes the heater 22*a* to heat the fixing device 22 up to an operatable temperature.

In the next step, the print control unit 21 controls a developing-transfer process motor (PM) 3 to rotate through a driver 2. At the same time, the print control unit 21 turns on a charging voltage power source 25 with a charge signal SGC, thereby charging a developing device 27.

In the next step, a sheet remaining amount sensor 8 and a sheet size sensor 9 detect a sheet (not shown) and a type thereof, and the sheet is transported. A sheet supply motor (PM) 5 is capable of rotating in two directions through a driver 4. The sheet supply motor (PM) 5 rotates in a reverse direction to transport the sheet for a specific distance until a sheet inlet sensor 6 detects the sheet. Then, the sheet supply motor (PM) 5 rotates in a forward direction to transport the sheet into a printing mechanism in the electro-photography printer.

As shown in FIGS. 1 and 2, when the sheet reaches a printable position, the print control unit 21 sends a timing signal SG3 (including a main scanning synchronization signal and a sub scanning synchronization signal) to the upper controller, and the print control unit 21 receives the video signal SG2 from the upper controller. The upper controller edits the video signal SG2 per page. When the print control unit 21 receives the video signal SG2, the print control unit 21 sends the video signal SG2 as a print data signal HD-DATA to an LED (Light Emitting Diode) head 24. The LED head 24 is formed of a plurality of LED elements arranged therein each for printing one dot (pixel).

When the print control unit 21 receives the video signal SG2 for one line, the print control unit 21 sends a latch signal HD-LOAD to the LED head 24, so that the print data signal HD-DATA is stored in the LED head 24. Note that the print control unit 21 is capable of printing the print data signal HD-DATA stored in the LED head 24 while the print control unit 21 receives a next video signal SG2 from the upper controller. A clock signal HD-CLK is also sent to the LED head 24 for sending the print data signal HD-DATA.

In the embodiment, the video signal SG2 is sent and received per print line. Information to be printed with the LED head 24 is converted to a static latent image on a photosensitive drum (not shown) charged with a negative potential as a dot with an increased potential. In the developing device 27, toner charged with a negative potential is attracted to each dot through an electric attraction force, thereby forming a toner image.

In the next step, the sheet is transported to a transfer device 28. A transfer voltage power source 26 becomes a negative potential with a transfer signal SG4, so that the transfer device 28 transfers the toner image to the sheet passing between the photosensitive drum and the transfer device 28.

After the toner image is transferred to the sheet, the sheet abuts against the fixing device 22 with the heater 22*a* disposed therein, and is transported further, thereby fixing the toner image to the sheet through heat of the fixing device 22. After the toner image is fixed to the sheet, the sheet is transported further, and is discharged to outside the printer after passing through a sheet discharge outlet sensor 7.

In the embodiment, the print control unit 21 applies a voltage from the transfer voltage power source 26 to the transfer device 28 only when the sheet passes through the transfer device 28 according to detections of the sheet size sensor 9 and the sheet inlet sensor 6. After the printing operation is performed, the print control unit 21 stops supplying the voltage from the charging voltage power source 25 to the developing device 27, and stops the developing-transfer process motor 3. Afterward, the operation described above is repeated.

Figure 3:
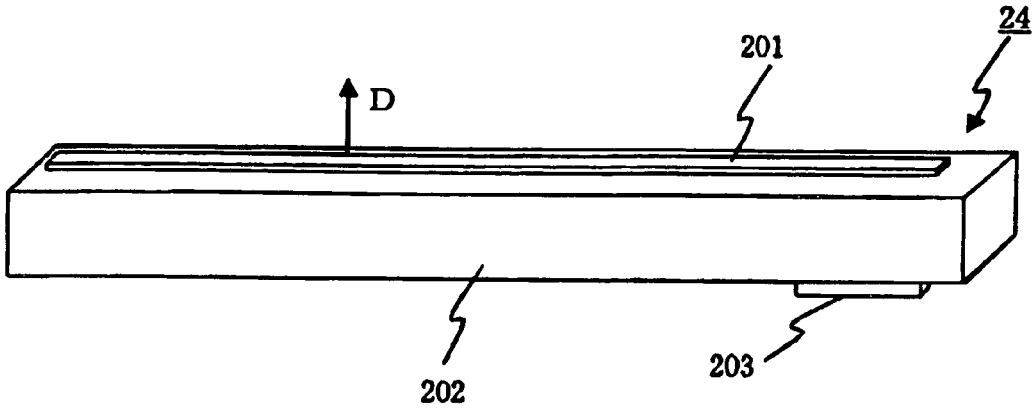
FIG. 3 is a schematic perspective view showing an LED (Light Emitting Diode) head according to the first embodiment of the present invention.

A structural configuration of the LED head 24 will be explained next. FIG. 3 is a schematic perspective view showing the LED (Light Emitting Diode) head 24 according to the first embodiment of the present invention.

As shown in FIG. 3, the LED head 24 includes a rod lens array 201 in which a plurality of rod lenses is arranged in a right-left direction. Further, the LED head 24 includes a holder 204 for holding the rod lens array 201 and other components constituting the LED head 24. Further, the LED head 24 includes a connector 203 to be connected to a cable for supplying power and a signal for controlling an internal circuit of the LED head 24 from outside the LED head 24. The LED head 24 emits light in an arrow direction D.

Figure 4:
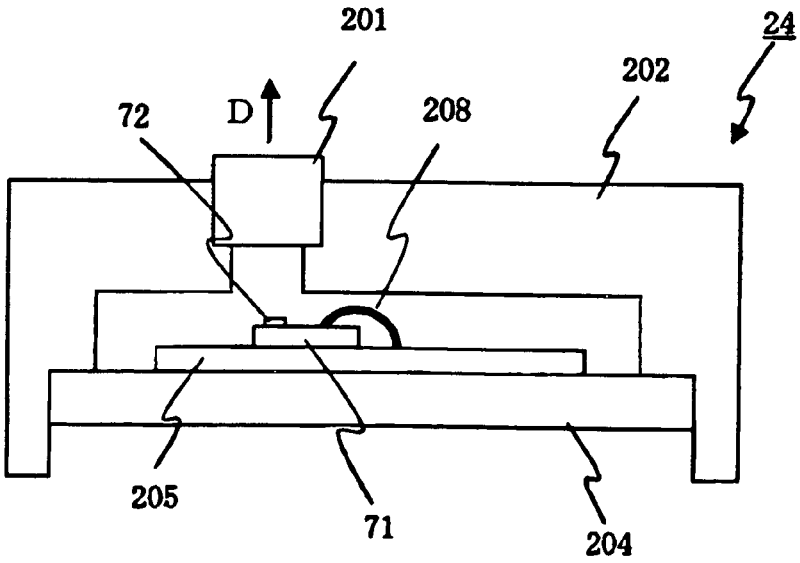
FIG. 4 is a schematic sectional view showing the LED head according to the first embodiment of the present invention.

FIG. 4 is a schematic sectional view showing the LED head 24 according to the first embodiment of the present invention. As shown in FIG. 4, the LED head 24 includes a base member 204 for mounting a light emitting unit inside the LED head 24. The light emitting unit includes a circuit board 205, a driver IC (Integrated Circuit) 71 (described later), and an LED array 72. The circuit board 205 is formed of a glass-epoxy member with a wiring portion formed thereon for mounting and connecting en electric component.

In the embodiment, the driver IC 71 is provided for driving an LED element. A total 26 of the LED arrays 72 are arranged, and each of the LED arrays 72 includes 192 of the LED elements. The LED elements are attached to a surface of the driver IC 72.

The LED arrays 72 are disposed each corresponding to a drive circuit of the driver IC 72, and are arranged in a right-left direction in FIG. 3. The LED elements are connected to the driver IC 71 through, for example, a semiconductor manufacturing process, so that the LED elements are connected to the driver IC 71 with an electrode wiring portion attached to surfaces of the LED element and the driver IC 71.

In the embodiment, a bonding wire 208 is provided for connecting the driver IC 71 to a pad disposed on the circuit board 205. Accordingly, power and a signal are input through the connector 203 shown in FIG. 3, and are supplied to the driver IC 71 through the bonding wire 208. A clamper (not shown) urges the base member 204 from above and below against the holder 202, so that the LED array 72 and the rod lens array 201 are positioned.

In the embodiment, when the driver IC 71 drives the LED elements disposed in the LED array 72, the LED elements emit light, so that light passes through the rod lens array 201 in the arrow direction D to form an image. When the LED head 24 is used as an exposure device of the electro-photography printer as an image forming apparatus, a photosensitive drum is disposed along the arrow direction D. A distance between the LED head 24 and the photosensitive drum is adjusted such that light emitted from the LED elements forms an image on a surface of the photosensitive drum.

Figure 5:
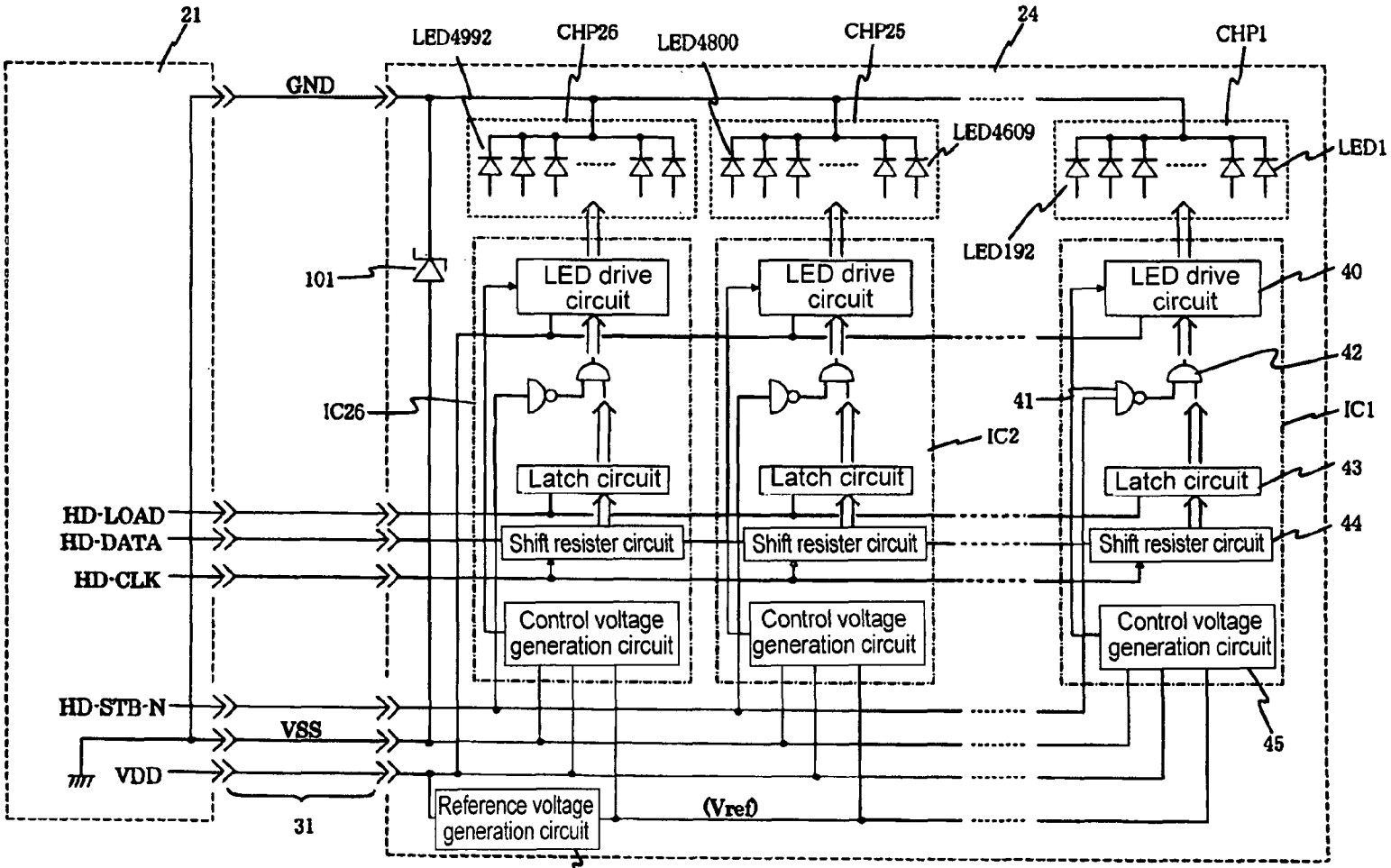
FIG. 5 is a block diagram showing the LED head and a print control unit according to the first embodiment of the present invention.

An electrical configuration of the LED head 24 will be explained next. FIG. 5 is a block diagram showing the LED head 24 and the print control unit 21 according to the first embodiment of the present invention.

In the following description, as an example, the LED head 24 is capable of printing on a sheet with A-4 size at a resolution of 600 dots per one inch. In the embodiment, the LED head 19 includes a total of 4992 dots of the LED elements. More specifically, the LED head 19 includes 26 of the LED arrays, and each LED array is formed of 192 of the LED elements.

As shown in FIG. 5, the print control unit 21 is connected to the LED head 24 through a connection cable 31. The connection cable 31 includes a GND line for flowing a ground current to the LED elements; lines for sending the print data signal HD-DATA, the clock signal HD-CLK, the latch signal HD-LOAD, and the strobe signal HD-STB-N; a VSS cable as ground of control units of the driver ICs IC1 to IC26; and a VDD cable as power source of the LED head 24.

As shown in FIG. 5, the LED head 24 includes LED arrays CHP1 and CHP26, and LED arrays CHP2 to CHP25 are omitted in FIG. 5. The driver ICs IC1 and IC 26 are arranged to correspond to the LED arrays CHP1 and CHP26 for driving the LED arrays CHP1 and CHP26, respectively. The driver ICs IC1 and IC 26 are formed of an identical circuit, and adjacent driver ICs are connected in a cascade connection. The driver ICs IC1 and IC 26 have ground connected to with each other as the VSS cable connected to the print control unit 21 through the connection cable 31.

In the embodiment, the LED array CHP1 includes LED elements LED1 to LED192, and 192 of LED elements are arranged in one LED array. That is, the LED array CHP25 includes LED elements LED4609 to LED4800, and the LED array CHP26 includes LED elements LED4801 to LED4992. The LED elements LED1 to LED4992 in the LED arrays CHP1 to CHP26 have cathode terminals collectively connected with each other to be a GND wiring portion connected to the print control unit 21 through the connection cable 31.

In the LED head 24 shown in FIG. 5, 26 of the LED arrays (CHP1 to CHP26) and 26 of the driver ICs (IC1 to IC26) for driving the LED arrays are arranged on a print circuit board (not shown) to face each other. One chip of the driver IC is capable of driving 192 of the LED elements, and 26 chips of the driver ICs are connected in a cascade connection for transmitting in serial print data input from outside. The GND cable and the VSS cable of the connection cable 31 are connected inside a power source unit disposed in the print control unit 21 to have a same potential.

In the embodiment, each of the driver ICs (IC1 to IC26) is formed of an identical circuit, and adjacent driver ICs are connected in a cascade connection.

In the embodiment, each of the driver ICs includes a shift resister circuit 44 for receiving the clock signal HD-CLK and performing shift transfer of print data; a latch circuit 43 for latching an output signal of the shift resister circuit 44 according to a latch signal (referred to as HD-LOAD); an AND circuit 42 for receiving outputs of the latch circuit 43 and an inverter circuit 41 to obtain a logic product; an LED drive circuit 40 for supplying a drive current from the power source VDD to the LED elements (CHP1 etc.) according to an output signal of the AND circuit 42; and a control voltage generation circuit 45 for generating a control voltage, so that the drive current of the LED drive circuit 35 becomes constant. The strobe signal HD-STB-N is input to the inverter circuit 41.

Further, a reference voltage generation circuit 46 is provided. A power source terminal of the reference voltage generation circuit 46 is connected to the power source VDD, and a ground terminal thereof is connected to ground (VSS) of the LED head 24. Further, an output terminal of the reference voltage generation circuit 46 is connected to the control voltage generation circuit 45 of each of the driver ICS IC1 to IC26 for supplying the reference voltage Vref.

Further, a diode 101 is provided. An anode terminal of the diode 101 is connected to ground (VSS) of the LED head 24, and a cathode terminal thereof is connected to the GND cable for flowing a ground current of each of LEDs. The diode 101 may include a silicon rectifying diode, and more preferably, may include a Schottky diode, thereby reducing a forward voltage.

Figure 6:
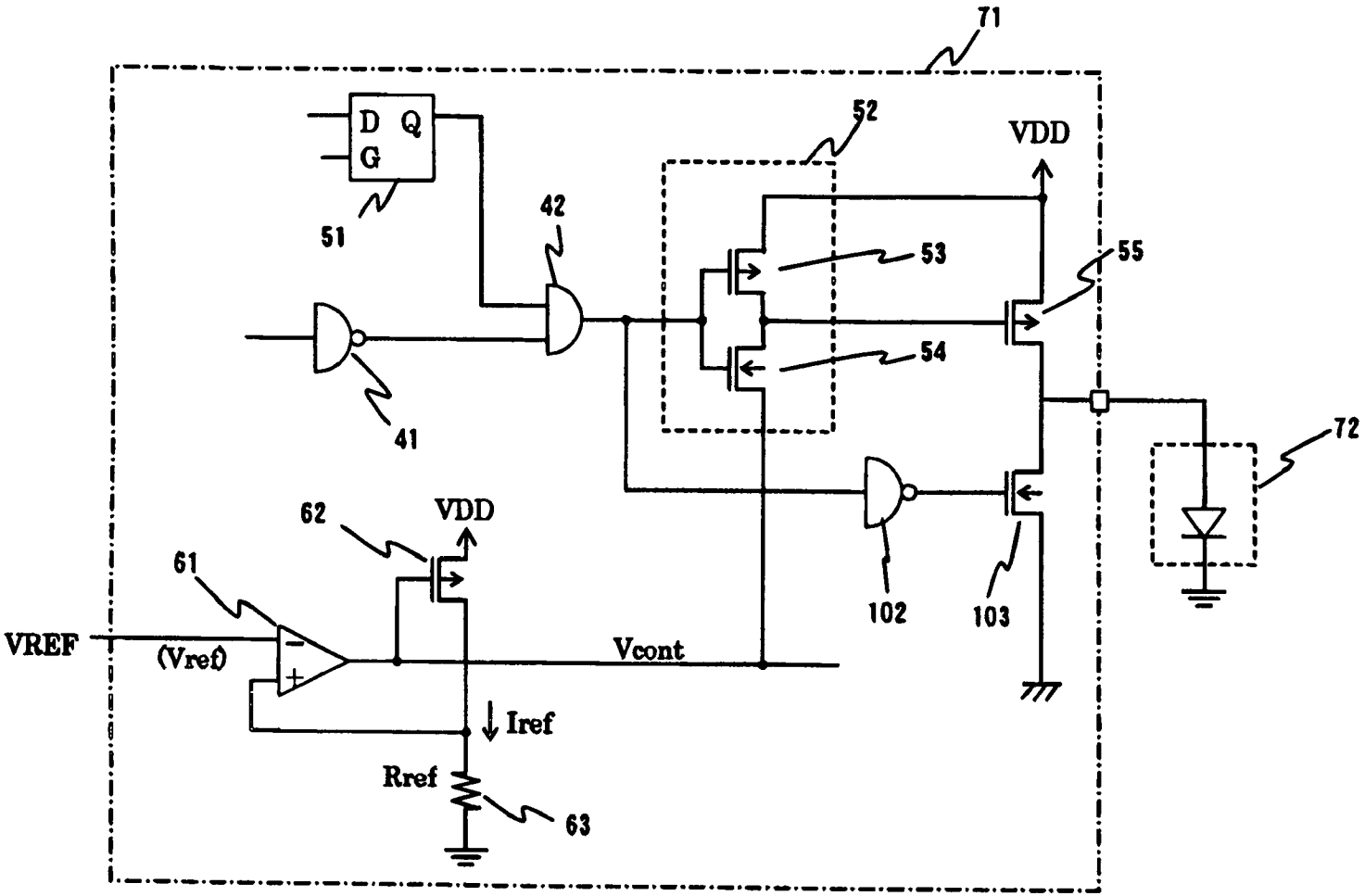
FIG. 6 is a circuit diagram showing a driver IC (Integrated Circuit) and an LED array according to the first embodiment of the present invention.

FIG. 6 is a circuit diagram showing the driver IC (Integrated Circuit) and the LED array according to the first embodiment of the present invention. FIG. 6 shows a connection relationship of the LED drive circuit and a peripheral portion thereof, and dot 1 (a peripheral portion the drive circuit of the LED 1) is shown as an example. As described above, the LED drive current is determined according to the reference current generated in the driver IC.

In FIG. 6, an area 71 surrounded with a hidden line represents the driver IC, and an area 72 corresponds to the LED array. As shown in FIG. 6, the LED drive circuit includes the inverter circuit 41, the AND circuit 42, and the latch circuit 51 corresponding to one element of the latch circuit 43 shown in FIG. 5. The latch circuit 51 has a input terminal D connected to an output terminal of a shift register (not shown, corresponding to the shift resister circuit 44 in FIG. 5); an input terminal G connected to the latch signal HD-LOAD; and an output terminal Q connected to one of input terminals of the AND circuit 42.

The inverter circuit 52 is formed of a PMOS transistor 53 and an NMOS transistor 54. A source terminal of the PMOS transistor 53 is connected to the power source VDD. Drain terminals and gate terminals of the PMOS transistor 53 and the NMOS transistor 54 are connected to with each other. A source terminal of the NMOS transistor 54 is connected to an output terminal of the operational amplifier 61, so that a potential Vcont is applied to the source terminal of the NMOS transistor 54. A PMOS transistor 55 is also provided. A gate terminal of the PMOS transistor 55 is connected to the drain terminals of the PMOS transistor 53 and the NMOS transistor 54.

In the embodiment, an NMOS transistor 103 is also provided. A drain terminal of the NMOS transistor 103 is connected to a drain terminal of the PMOS transistor 55 and an output terminal DO of the driver IC 71. A source terminal of the NMOS transistor 103 is connected to ground (VSS) of the driver IC 71.

Further, an inverter circuit 102 is provided. An input terminal of the inverter circuit 102 is connected to the output terminal of the AND circuit 42. An anode terminal of the LED element LED1 is connected to the output terminal DO of the driver IC 71, and a cathode terminal thereof is connected to ground (GND) of the LED elements.

The operational amplifier 61 has an output voltage as the potential Vcont. A resistor 63 has a resistivity of Rref. A PMOS transistor 62 has a gate length same as that of the PMOS transistor 55. The reference voltage generation circuit 46 shown in FIG. 5 generates the reference voltage Vref connected to an inverse input terminal of the operational amplifier 61.

A source terminal of the PMOS transistor 62 is connected to the power source VDD, a gate terminal thereof is connected to the output terminal of the operational amplifier 61, and a drain terminal thereof is connected to one end portion of the resistor 63 and a non-reverse input terminal of the operational amplifier 61.

A feedback circuit is formed of the operational amplifier 61, the PMOS transistor 62, and the resistor 63, so that a current flowing through the resistor 63, that is, a current flowing through the PMOS transistor 62, is determined only by the reference voltage Vref and the resistivity Rref of the resistor 63 regardless of a power voltage of the power source VDD.

When the NMOS transistor 54 is turned on, the PMOS transistor 53 becomes an off state. The PMOS transistor 55 has a gate potential same as that of the Vcont potential. Accordingly, the PMOS transistor 55 has a gate-source voltage same as that of the PMOS transistor 62, thereby constituting a current-mirror relationship. As a result, it is possible to adjust the drain current of the PMOS transistor 55 according to the reference voltage Vref, thereby controlling the drive current of the LED element in the LED array 72 at a specific level.

Figure 7:
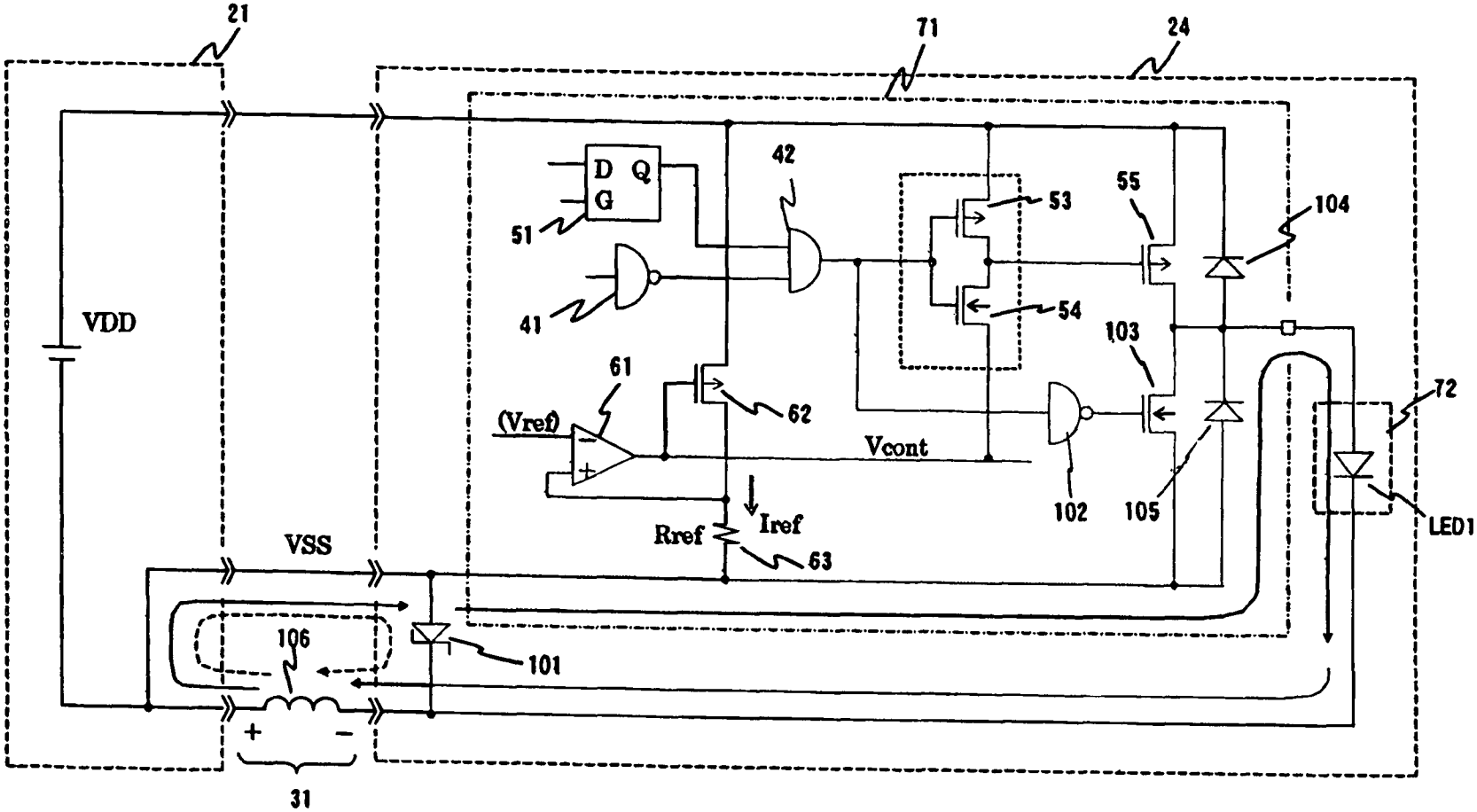
FIG. 7 is a circuit diagram showing a drive circuit according to the first embodiment of the present invention.

FIG. 7 is a circuit diagram showing the drive circuit according to the first embodiment of the present invention. In FIG. 7, the output signals of the print control unit 21 are omitted. In the connection cable 31, the control signals and the likes are omitted, and only the power source VDD, the ground VSS of the driver IC, and the ground GND of the LEDs are shown.

The connection cable 31 has a wire resistivity and a lead inductance component according to a cable length. In FIG. 7, the connection cable 31 has an inductance component 106 generated in the ground GND of the LEDs. Note that diodes 104 and 105 are generated as parasite elements of the PMOS transistor 55 and the NMOD transistor 103, respectively.

When an instruction is sent for driving the LEDs, the strobe signal HD-STB-N is generated to change an output of the inverter circuit 41 from a low state to a high state. At this time, the print data are turned on, and the Q output of the latch circuit 51 becomes a high state in advance. Accordingly, an output of the AND circuit 42 changes from a low state to a high state. As a result, the NMOS transistor 54 is turned on, and the PMOS transistor 53 is turned off. Accordingly, the gate potential of the PMOS transistor 55 decreases from the power source VDD to the potential Vcont.

As a result, the PMOS transistor 55 has the gate-source voltage the same as that of the PMOS transistor 62, thereby establishing the current-mirror relationship. Accordingly, a current proportional to the reference voltage Vref flowing through the PMOS transistor 62 flows through the PMOS transistor 55, thereby driving the LED element LED1 to emit light.

When the output of the AND circuit 42 becomes the high state, an output of the inverter circuit 102 becomes a low state, thereby turning off the NMOS transistor 103. Accordingly, in driving the LEDs, it is possible to adjust the drain current of the PMOS transistor 55 according to the reference voltage Vref, thereby controlling the drive current of the LED elements of the LED array 72 at a specific level.

When an instruction is sent for stopping driving the LEDs, the strobe signal HD-STB-N is input to change the output of the inverter circuit 41 from the high state to the low state. Accordingly, the output of the AND circuit 42 changes from the high state to the low state. As a result, the NMOS transistor 54 is turned off, and the PMOS transistor 53 is turned on. Accordingly, the gate potential of the PMOS transistor 55 increases from the potential Vcont to the power source VDD, thereby turning off the PMOS transistor 55.

Figure 17:
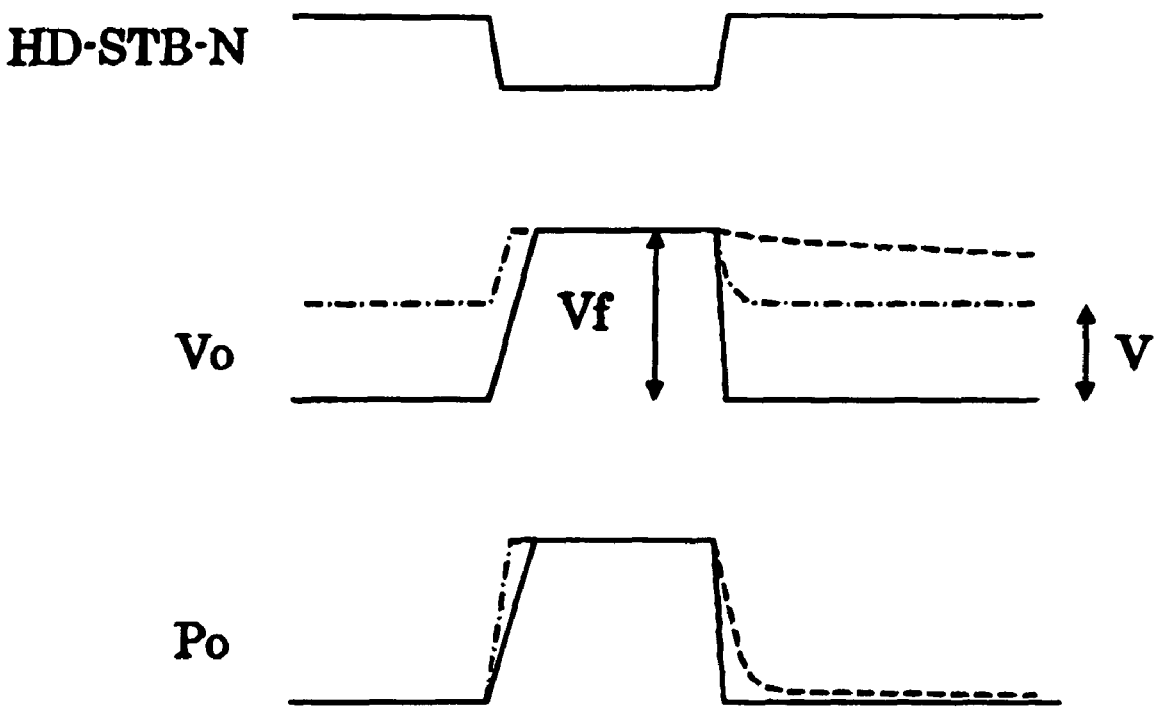
FIG. 17 CONVENTIONAL ART
FIG. 17 is a graph showing drive waves of the LED drive circuits shown in FIGS. 16(*a*) to 16(*c*) of the conventional electro-photography printer.

When the output of the AND circuit 42 becomes the low state, the output of the inverter circuit 102 becomes a high state, thereby turning on the NMOS transistor 103. When the LEDs emit light, a floating capacity (not shown) of the LED element LED1 is charged with the forward voltage (about 1.6 V) of the LED. Accordingly, when the NMOS transistor 103 is turned on upon receiving the instruction to turn off the LED, charges in the floating capacity are discharged toward the ground VSS. As a result, the LED element is driven along a luminescent output Po indicated with a solid line in FIG. 17, thereby making an initial rise time of the luminescent output Po small.

Figure 15:
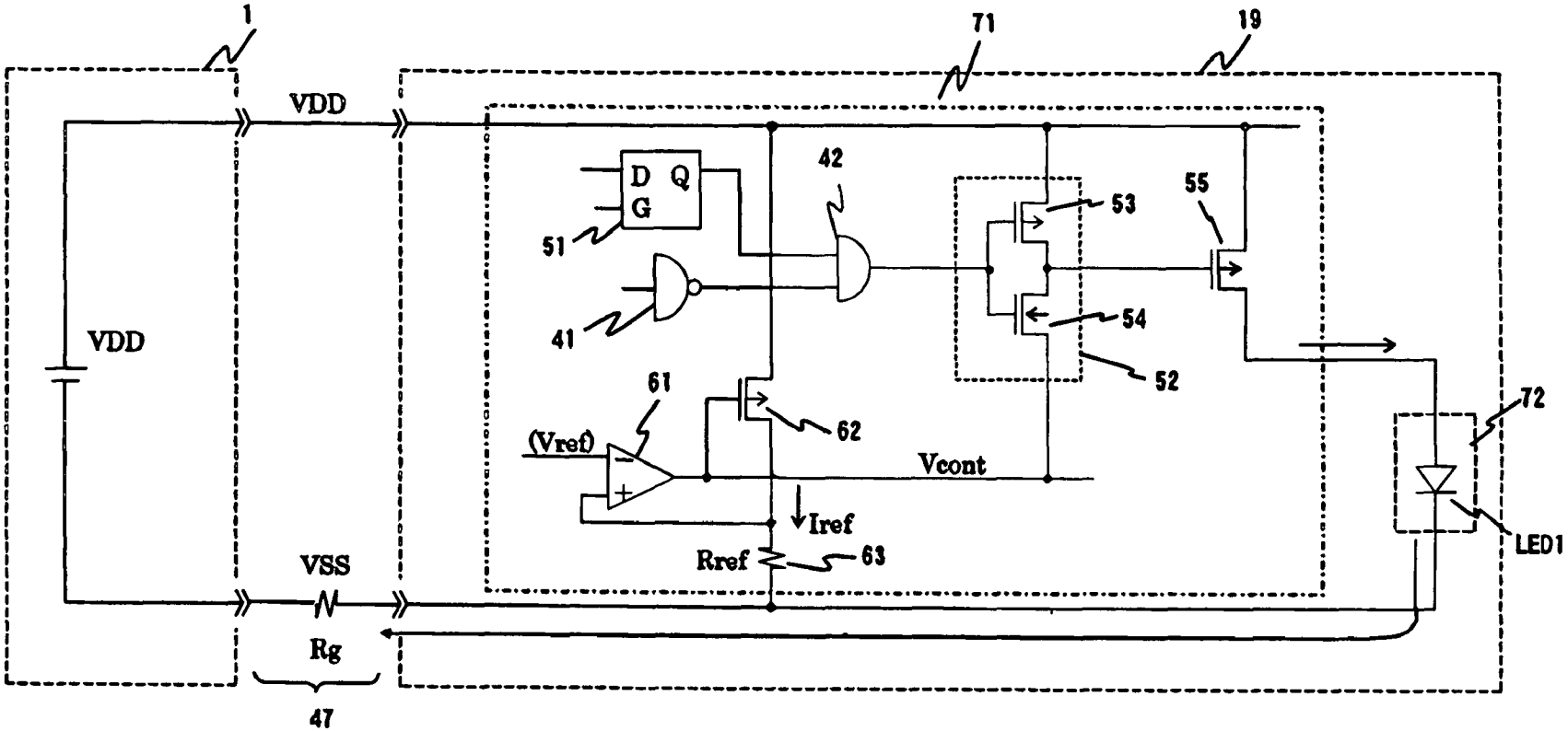
FIG. 15 CONVENTIONAL ART
FIG. 15 is a circuit diagram showing the LED drive circuit and the print control unit of the conventional electro-photography printer.
Figure 16:
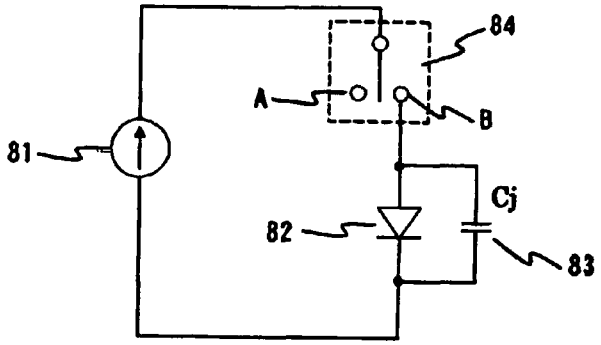
FIG. 16 (a) CONVENTIONAL ART
FIGS. 16(*a*) to 16(*c*) are circuit diagrams showing the LED drive circuits of the conventional electro-photography printer.
Figure 16:
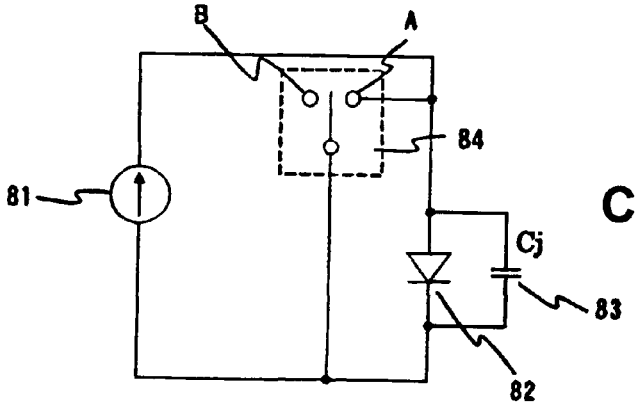
FIG. 16 (b) CONVENTIONAL ART
Figure 16:
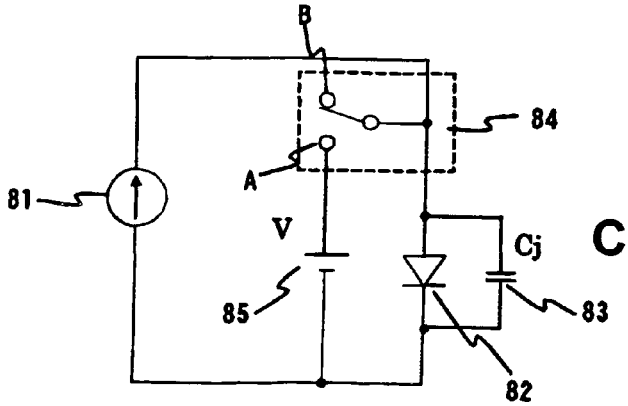
FIG. 16 (c) CONVENTIONAL ART

In a conventional drive circuit shown in FIG. 15, the power source VDD is provided as a drive power source for a driver IC. A return current from an LED array is transmitted through a path the same as ground of the driver IC. When a drive current of an LED element LED1 of the drive circuit shown in FIG. 15 is 3 mA, a total current for driving a total 4992 dots of LEDs is given by:

$$4992 \times 3\ \text{mA} = 14876\ \text{mA} \approx 15\ \text{A}$$

Accordingly, when a ground wiring resistor Rg of a connection cable 47 is 0.1Ω, a voltage of 1.5 V is generated in the ground wiring resistor Rg upon driving all of the LEDs.

The voltage described above may vary when the LED drive is turned on and off, or depending on the number of the dots. Accordingly, the power source voltage may vary due to a variance in the voltage, thereby causing an obstacle such as a noise to an operation. As a result, when print data are not transmitted normally, wrong information may be printed, or a control circuit may not be able to follow a variance in the power source voltage, thereby causing a variance in a print density.

As described above, when the connection cable 31 has a large length, an inductance component thereof as well as the resistivity increases. When a large switching current change (ΔI) occurs in a short period of time (Δt) in a cable with an inductance component (L), a reverse induced voltage is given by:

$$L \times (\Delta I / \Delta t)$$

The reverse induced voltage may cause a noise voltage, thereby causing a false operation or a latch up phenomenon (described later).

As described above, the connection cable 31 has a length determined by an arrangement design of each unit in the printer. Accordingly, when the printer has a large size, it is necessary to increase a length of the connection cable 31. In order to decrease a wiring resistivity, it is necessary to increase a sectional area of a conductive wire of the connection cable 31. When a sectional area of a conductive wire of the connection cable 31 increases, the connection cable 31 loses flexibility. Accordingly, it is difficult to properly maintain a distance between the LED head and the photosensitive drum, thereby causing out-focus and limiting a design of the printer.

Figure 8:
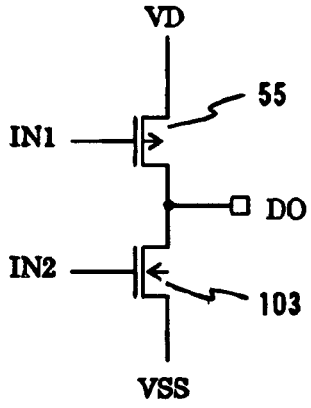
FIGS. 8(*a*) to 8(*c*) are circuit diagrams showing an operation of the drive circuit according to the first embodiment of the present invention, wherein FIG. 8(*a*) is a circuit diagram showing a PMOS transistor and a NMOS transistor, FIG. 8(*b*) is a sectional view showing the PMOS transistor and the NMOS transistor taken along gate terminals, source terminals, and drain terminals thereof, and FIG. 8(*c*) is an equivalent circuit diagram of the circuit diagram shown in FIG. 8(*a*)
Figure 8:
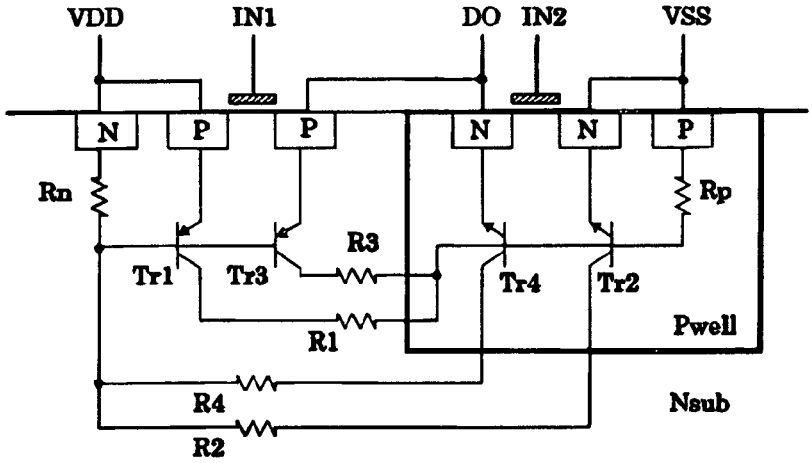
Figure 8:
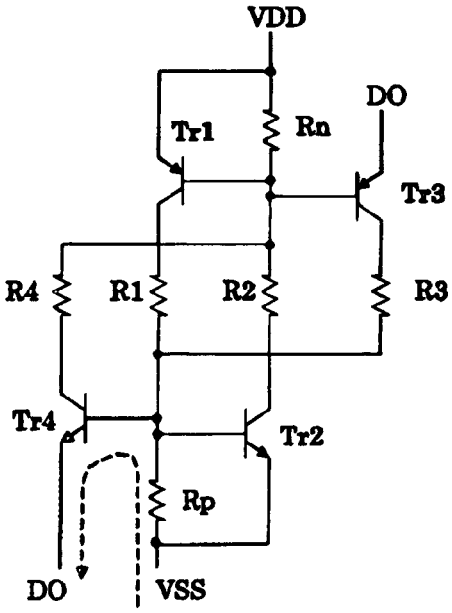

FIGS. 8(*a*) to 8(*c*) are circuit diagrams showing an operation of the drive circuit according to the first embodiment of the present invention. More specifically, FIG. 8(*a*) is a circuit diagram showing the PMOS transistor 55 and the NMOS transistor 103, FIG. 8(*b*) is a sectional view showing the PMOS transistor 55 and the NMOS transistor 103 taken along the gate terminals, the source terminals, and the drain terminals thereof, and FIG. 8(*c*) is an equivalent circuit diagram of the circuit diagram shown in FIG. 8(*a*).

As shown in FIG. 8(*a*), the source terminal of the PMOS transistor 55 is connected to the power source VDD. The drain terminal of the PMOS transistor 55 is connected to the drain terminal of the NMOS transistor 103 and the output terminal DO of the driver IC. The source terminal of the NMOS transistor 103 is connected to the ground VSS of the driver IC. The gate terminals of the PMOS transistor 55 and the NMOS transistor 103 are connected to abbreviated signals IN1 and IN2.

As shown in FIG. 8(*b*), a silicon wafer Nsub constituting the driver IC is formed of a member containing an N-type impurity. A P-type area Pwell surrounded by a heavy line is formed in the silicon wafer Nsub in an island shape. The gate terminals of the PMOS transistor 55 and the NMOS transistor 103 are indicated as hatched areas connected to the abbreviated signals IN1 and IN2. The source areas and the drain areas of the PMOS transistor 55 and the NMOS transistor 103 are arranged on both sides of the gate terminals as areas P and N with a P-type impurity or an N-type impurity introduced therein.

In the embodiment, PNP bio-polar transistors Tr1 and Tr3 and NPN bio-polar transistors Tr2 and Tr4 are provided as parasite elements of the PMOS transistor 55 and the NMOS transistor 103.

In the embodiment, an emitter terminal of the PNP bio-polar transistor Tr1 is connected to the source terminal of the PMOS transistor 55. An emitter terminal of the PNP bio-polar transistor Tr3 is connected to the drain terminal of the PMOS transistor 55. Base terminals of the PNP bio-polar transistors Tr1 and Tr3 are connected to the silicon wafer Nsub, and are connected to an N-type area for a substrate contact through a resistor Rn of the silicon wafer Nsub, and further to the power source VDD.

In the embodiment, an emitter terminal of the NPN bio-polar transistor Tr2 is connected to the source terminal of the NMOS transistor 103. An emitter terminal of the NPN bio-polar transistor Tr4 is connected to the drain terminal of the NMOS transistor 103. Base terminals of the NPN bio-polar transistors Tr2 and Tr4 are connected to the P-type area Pwell, and are connected to a P-type area for a substrate contact through a resistor Rp of the P-type area Pwell, and further to the ground VSS.

In the embodiment, resistors R1 to R4 are provided as collector resistors of the PNP bio-polar transistors Tr1 and Tr3 and the NPN bio-polar transistors Tr2 and Tr4. One end portions of the resistors R1 to R4 are connected to collector terminals of the PNP bio-polar transistors Tr1 and Tr3 and the NPN bio-polar transistors Tr2 and Tr4. The other end portions of the resistors R1 and R3 are connected to the base terminals of the NPN bio-polar transistors Tr2 and Tr4. The other end portions of the resistors R2 and R4 are connected to the base terminals of the resistors R1 and R3.

The latch up phenomenon will be explained next. In the equivalent circuit diagram shown in FIG. 8(*c*), a destructive factor called the latch up phenomenon may occur in an element having a CMOS structure.

It is supposed that a current flows in a hidden line arrow direction in the equivalent circuit diagram shown in FIG. 8(*c*). When the current flows from the ground VSS to the output terminal DO of the CMOS, the current flows as a forward current between the base terminal and the emitter terminal of the NPN bi-polar transistor Tr4. Accordingly, the NPN bi-polar transistor Tr4 is turned on, and a current flows between the collector terminal and the emitter terminal of the NPN bi-polar transistor Tr4.

The current flows from the power source VDD to the collector terminal of the NON bi-polar transistor Tr4 through the resistors Rn and R4. When the current flows through the resistor Rn, a potential difference or a voltage is generated between the both end portions of the resistor Rn. The voltage is applied as a forward voltage between the emitter terminal and the base terminal of the PNP bi-polar transistor Tr1, thereby turning on the PNP bi-polar transistor Tr1. When the PNP bi-polar transistor Tr1 is turned on, a collector current is generated and flows to the ground VSS through the resistors R1 and Rp.

When the current flows through the resistor Rp, a potential difference or a voltage is generated between the both end portions of the resistor Rp. The voltage is applied as a forward voltage between the emitter terminal and the base terminal of the NPN bi-polar transistor Tr2, thereby turning on the PNP bi-polar transistor Tr2. When the NPN bi-polar transistor Tr2 is turned on, a collector current is generated and flows from the power source VDD through the resistors Rn and R2 to the ground VSS through the collector terminal and the emitter terminal of the NPN bi-polar transistor Tr2.

When the collector current of the PNP bi-polar transistor Tr2 flows through the resistor Rn, a potential difference or a voltage is generated between the both end portions of the resistor Rn, thereby increasing the forward voltage between the emitter terminal and the base terminal of the PNP bi-polar transistor Tr1.

As a result, even after the current flowing in the arrow direction between the base terminal and the emitter terminal of the NPN bi-polar transistor Tr4 disappears, the PNP bi-polar transistor Tr1 and the NPN bi-polar transistors Tr2 and Tr4 continue to be turned on, so that the current keeps flowing from the power source VDD to the ground VSS. The current has a large value and causes heating, thereby damaging a component in the circuit diagram shown in FIG. 8(*a*), i.e., the latch up phenomenon.

In the embodiment, it is possible to prevent the latch up phenomenon with the following mechanism. It is supposed that the diode 101 is omitted from the circuit diagram shown in FIG. 7. As described above, the connection cable 31 has the inductance component 106. When all of the LEDs emit light, the total current of about 15 A flows through the ground GND, i.e., the inductance component 106.

When all of the LEDs stop emitting light according to an LED turn-off instruction, the reverse induced voltage is generated at the both end portions of the inductance 106. Accordingly, the current flows in the arrow direction due to the reverse induced voltage, so that the LED drive current continues. The current flows from one end portion (+ end portion) of the inductance 106 through a connection point between the ground GND of the print control unit 21 and the ground VSS to the VSS cable of the connection cable 31. Then, the current flows in the forward direction through the LED1 through the parasite diode 102 in the driver IC 71 (a model component of the base terminal and the emitter terminal of the transistor Tr4 in FIG. 8(*c*)), and returns to the other end portion (– end portion) of the inductance 106. Accordingly, the current may cause the latch up phenomenon shown in FIG. 8(*c*).

Next, it is supposed that the circuit diagram shown in FIG. 7 is provided with the diode 101. In this case, when all of the LEDs stop emitting light, the current flows in a hidden arrow direction from the one end portion (+ end portion) of the inductance 106 through the connection point between the ground GND of the print control unit 21 and the ground VSS to the VSS cable of the connection cable 31. Then, the current returns to the other end portion (– end portion) of the inductance 106 through the anode terminal and the cathode terminal of the diode 101.

In the embodiment, the diode 101 is disposed near the connector connected to the connection cable 31 of the LED head 24. Accordingly, as opposed to a wiring resistance of the diode 105, it is possible to reduce a wiring resistance of the diode 101. As a result, it is possible to flow the current in a bypath indicated by the hidden arrow, thereby reducing the current flowing through the diode 105 to a negligible level. Therefore, it is possible to eliminate the current as a trigger of the latch up phenomenon shown as the arrow in FIG. 8(*c*).

As shown in FIG. 7, the connection cable 31 has the inductance component 106, and also has a resistance component. When the inductance component 106 is replaced with the resistance component, a potential difference is generated at both end portions of the resistance component upon turning on all of the LEDs. In this case, the VSS cable is separated from the ground GND, so that a voltage variance does not cause a significant effect on the VSS cable. Accordingly, it is possible to maintain the voltage variance between the power source VDD and the ground VSS at a small level. As a result, it is possible to prevent a false operation of a circuit component or a variance in a print density due to a variance in luminescent energy on the photosensitive drum.

Note that, similar to the ground GND, the power source VDD has an inductance component and a resistance component. Accordingly, it is difficult to completely eliminate the voltage variance through separating one of the ground routes. In the embodiment, as opposed to a case that the ground routes are not separated, it is possible to reduce the voltage variance in half.

As described above, in the embodiment, in addition to the PMOS transistor 55 in the LED drive circuit, the NMOS transistor 103 is provided for discharging charges accumulated in the capacity between the anode terminal and the cathode terminal of the LED upon tuning off the LED. Accordingly, it is possible to turn off the LED in a short period of time due to the current path for discharging charges accumulated in the capacity between the anode terminal and the cathode terminal of the LED upon tuning off the LED, thereby obtaining a fast printing operation of the printer.

Further, in the embodiment, the ground route for the LEDs is separated from the ground route of the driver IC, and the diode 101 is disposed between the ground routes. As a result, it is possible to prevent a false operation of the LED head due to a voltage decrease generated by a resistance component of the connection cable upon turning off the LED or a variance in a print density upon a printing operation. Further, it is possible to prevent the latch up phenomenon due to the reverse induced voltage generated by the inductance component 106 of the connection cable 31 upon turning off the LEDs, thereby preventing damage on the driver IC 71 and improving reliability of the driver IC 71.

Second Embodiment

Figure 9:
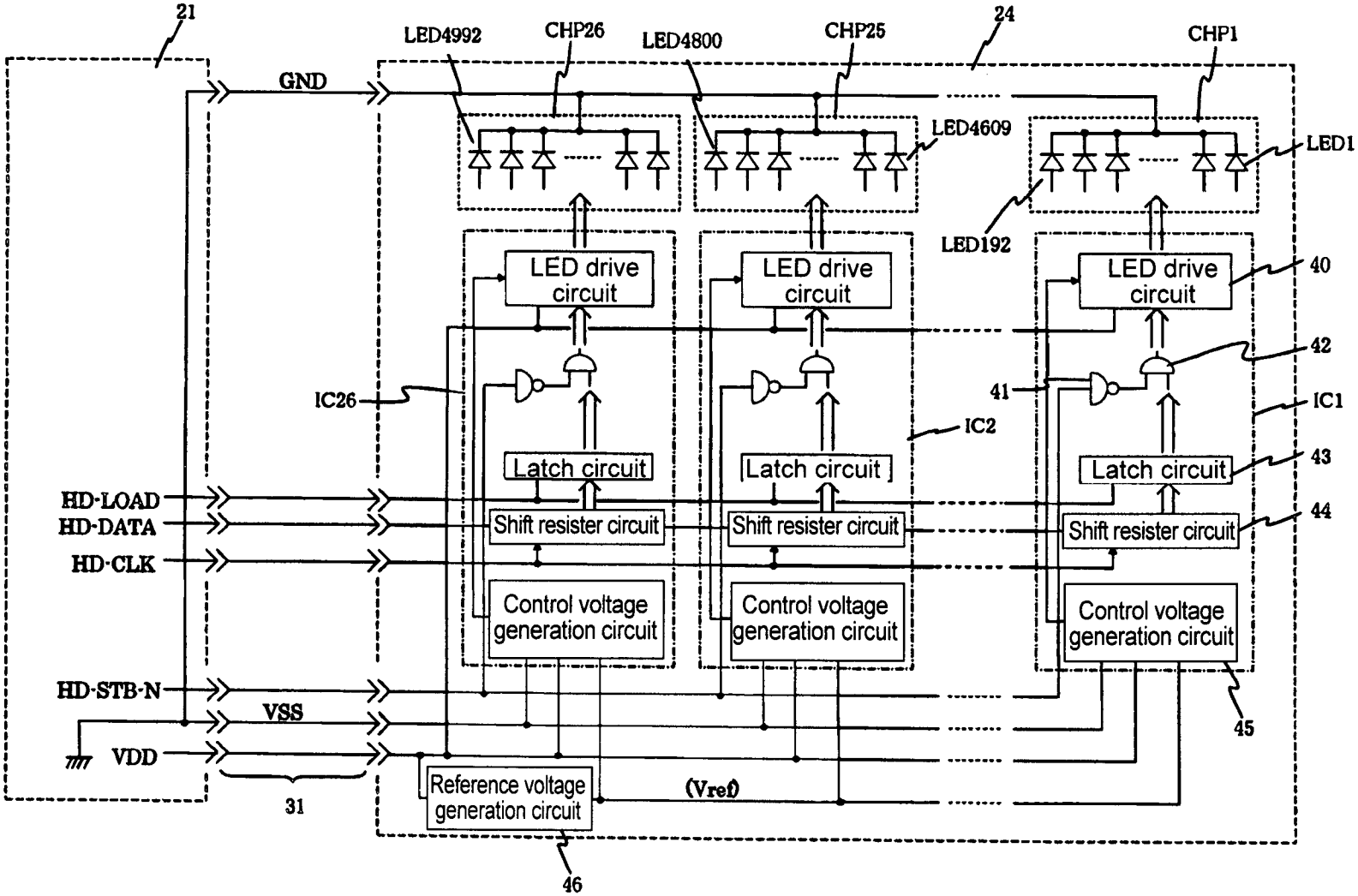
FIG. 9 is a block diagram showing an LED head and a print control unit according to a second embodiment of the present invention.

A second embodiment of the present invention will be explained next. FIG. 9 is a block diagram showing the LED head 24 and the print control unit 21 according to the second embodiment of the present invention.

As shown in FIG. 9, similar to those in the first embodiment, the LED head 24 is connected to the print control unit 21 through the connection cable 31. The connection cable 31 includes the GND line for flowing a ground current to the LED elements; the lines for sending the print data signal HD-DATA, the clock signal HD-CLK, the latch signal HD-LOAD, and the strobe signal HD-STB-N; the VSS cable as ground of the control units of the driver ICs IC1 to IC26; and the VDD cable as the power source of the LED head 24. The VSS cable and the GND line are separated in the connection cable 31, and are connected in the print control unit 21.

Figure 10:
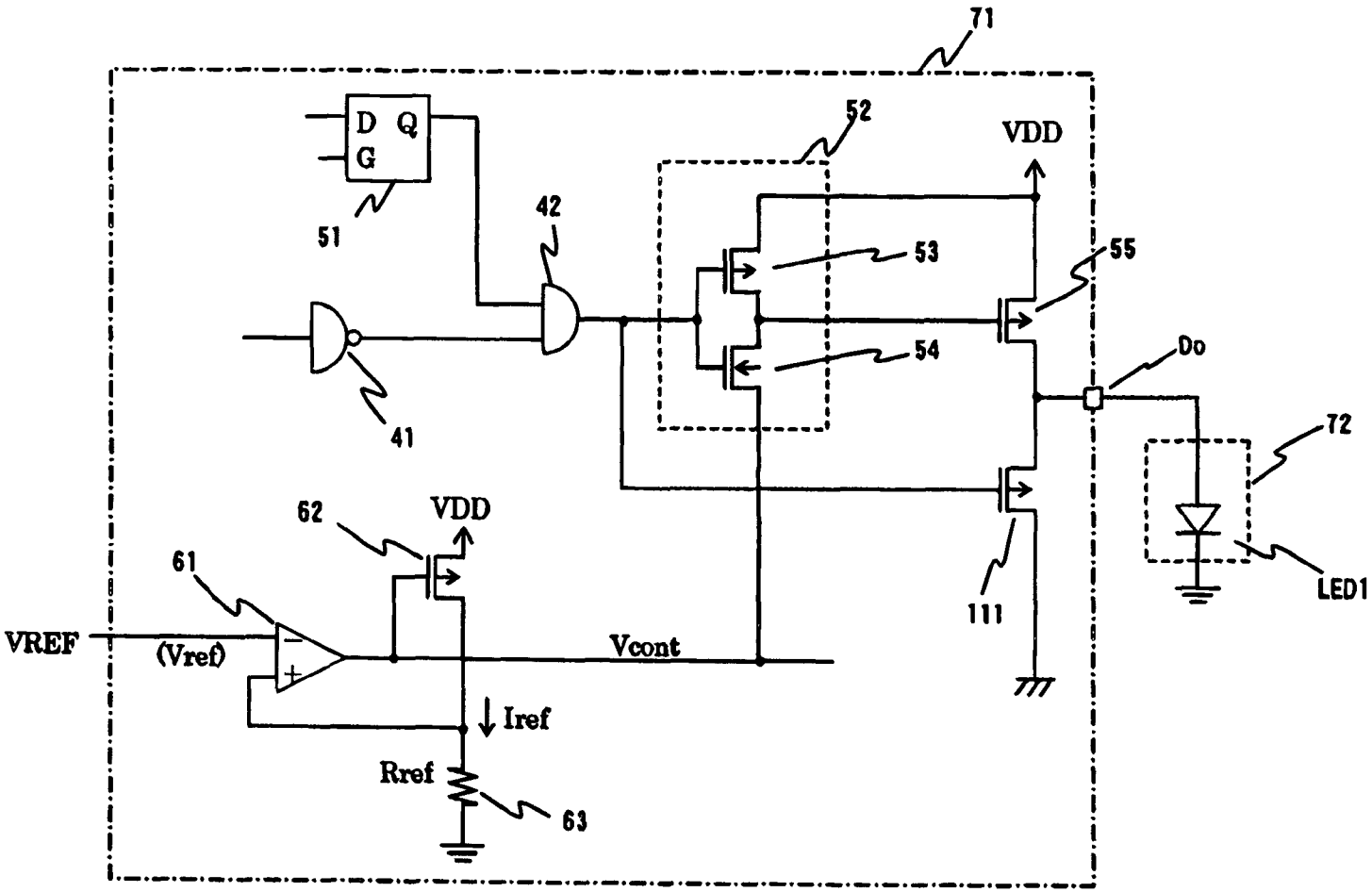
FIG. 10 is a circuit diagram showing a driver IC (Integrated Circuit) and an LED array according to the second embodiment of the present invention.

In the second embodiment, the diode 101 in the first embodiment is not provided. FIG. 10 is a circuit diagram showing a driver IC (Integrated Circuit) and an LED array according to the second embodiment of the present invention. FIG. 10 shows a connection relationship of the LED drive circuit and a peripheral portion thereof, and dot 1 (a peripheral portion the drive circuit of the LED 1) is shown as an example.

In FIG. 10, an area 71 surrounded with a hidden line represents the driver IC, and an area 72 corresponds to the LED array. As shown in FIG. 10, the LED drive circuit includes the inverter circuit 41, the AND circuit 42, and the latch circuit 51 corresponding to one element of the latch circuit 43 shown in FIG. 9. The latch circuit 51 has a D input terminal connected to an output terminal of a shift register (not shown, corresponding to the shift resister circuit 44 in FIG. 9); a G input terminal connected to the latch signal HD-LOAD; and a Q output terminal connected to one of input terminals of the AND circuit 42.

The inverter circuit 52 is formed of the PMOS transistor 53 and the NMOS transistor 54. A source terminal of the PMOS transistor 53 is connected to the power source VDD. Drain terminals and gate terminals of the PMOS transistor 53 and the NMOS transistor 54 are connected to with each other. A source terminal of the NMOS transistor 54 is connected to an output terminal of the operational amplifier 61, so that a potential Vcont is applied to the source terminal of the NMOS transistor 54. The PMOS transistor 55 is also provided. A gate terminal of the PMOS transistor 55 is connected to the drain terminals of the PMOS transistor 53 and the NMOS transistor 54.

In the embodiment, a PMOS transistor 111 is also provided. A source terminal of the PMOS transistor 111 is connected to the drain terminal of the PMOS transistor 55 and the output terminal DO of the driver IC 71. A drain terminal of the PMOS transistor 111 is connected to ground (VSS) of the driver IC 71. A gate terminal of the PMOS transistor 111 is connected to the output terminal of the AND circuit 42. The anode terminal of the LED element LED1 is connected to the output terminal DO of the driver IC 71, and a cathode terminal of the LED element LED1 is connected to ground (GND) for the LED elements.

The operational amplifier 61 has the output voltage as the potential Vcont. The resistor 63 has a resistivity of Rref. The PMOS transistor 62 has a gate length same as that of the PMOS transistor 55. The reference voltage generation circuit 46 shown in FIG. 9 generates the reference voltage Vref connected to an inverse input terminal of the operational amplifier 61.

A source terminal of the PMOS transistor 62 is connected to the power source VDD, a gate terminal thereof is connected to the output terminal of the operational amplifier 61, and a drain terminal thereof is connected to one end portion of the resistor 63 and a non-reverse input terminal of the operational amplifier 61.

A feedback circuit is formed of the operational amplifier 61, the PMOS transistor 62, and the resistor 63, so that a current flowing through the resistor 63, that is, a current flowing through the PMOS transistor 62, is determined only by the reference voltage Vref and the resistivity Rref of the resistor 63 regardless of a power voltage of the power source VDD.

When the NMOS transistor 54 is turned on, the PMOS transistor 53 becomes an off state. The PMOS transistor 55 has a gate potential same as that of the Vcont potential. Accordingly, the PMOS transistor 55 has a gate-source voltage same as that of the PMOS transistor 62, thereby constituting a current-mirror relationship. As a result, it is possible to adjust the drain current of the PMOS transistor 55 according to the reference voltage Vref, thereby controlling the drive current of the LED element in the LED array 72 at a specific level.

Figure 11:
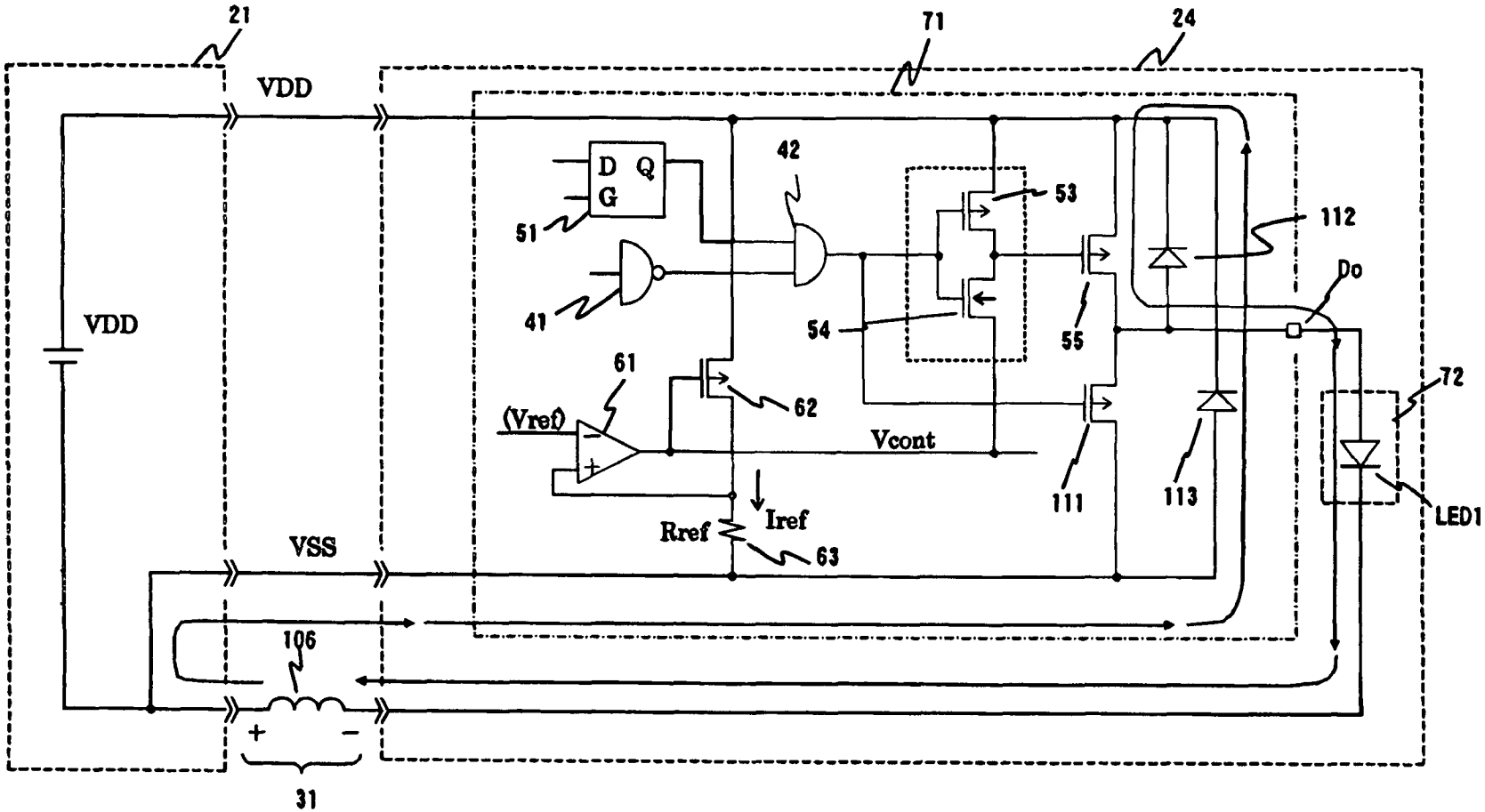
FIG. 11 is a circuit diagram showing a drive circuit according to the second embodiment of the present invention.

An operation of the drive circuit will be explained next. FIG. 11 is a circuit diagram showing the drive circuit according to the second embodiment of the present invention. In FIG. 11, the output signals of the print control unit 21 are omitted. In the connection cable 31, the control signals and the likes are omitted, and only the power source VDD, the ground VSS of the driver IC, and the ground GND of the LEDs are shown.

The connection cable 31 has a wire resistivity and a lead inductance component according to a cable length. In FIG. 11, the connection cable 31 has the inductance component 106 generated in the ground GND of the LEDs. Note that diodes 102 and 103 are generated as parasite elements of the PMOS transistor 55 and the NMOD transistor 111, respectively.

When an instruction is sent for driving the LEDs, the strobe signal HD-STB-N is generated to change an output of the inverter circuit 41 from a low state to a high state. At this time, the print data are turned on, and the Q output of the latch circuit 51 becomes a high state in advance. Accordingly, an output of the AND circuit 42 changes from a low state to a high state. As a result, the NMOS transistor 54 is turned on, and the PMOS transistor 53 is turned off. Accordingly, the gate potential of the PMOS transistor 55 decreases from the power source VDD to the potential Vcont.

As a result, the PMOS transistor 55 has the gate-source voltage the same as that of the PMOS transistor 62, thereby establishing the current-mirror relationship. Accordingly, a current proportional to the reference voltage Vref flowing through the PMOS transistor 62 flows through the PMOS transistor 55, thereby driving the LED1 to emit light.

At this moment, a voltage substantially equal to the power source VDD is applied to the gate terminal of the PMOS transistor 111, thereby turning off the NMOS transistor 111. Accordingly, in driving the LEDs, it is possible to adjust the drain current of the PMOS transistor 55 according to the reference voltage Vref, thereby controlling the drive current of the LED elements of the LED array 72 at a specific level.

When an instruction is sent for stopping driving the LEDs, the strobe signal HD-STB-N is input to change the output of the inverter circuit 41 from the high state to the low state. Accordingly, the output of the AND circuit 42 changes from the high state to the low state. As a result, the NMOS transistor 54 is turned off, and the PMOS transistor 53 is turned on. Accordingly, the gate potential of the PMOS transistor 55 increases from the potential Vcont to the power source VDD, thereby turning off the PMOS transistor 55.

When the output of the AND circuit 42 becomes the low state, the gate potential of the PMOS transistor 111 becomes a low state from a high state, thereby turning on the PMOS transistor 111. When the LEDs emit light, a floating capacity (not shown) of the LED1 is charged with the forward voltage (about 1.6 V) of the LED. Accordingly, when the PMOS transistor 103 is turned on upon receiving the instruction to turn off the LED, charges in the floating capacity are discharged toward the ground VSS.

As described above, the drain terminal of the PMOS transistor 111 is connected to the ground VSS, so that a potential thereof is substantially zero. When the LEDs are turned off and the gate potential of the PMOS transistor 111 becomes zero, a potential at the source terminal of the PMOS transistor 111 (connected to the output terminal DO) decreases from the voltage of about 1.6 V. When a gate-source voltage of the PMOS transistor 111 becomes a threshold voltage Vt (typically about 1 V), the drain current of the PMOS transistor 111 stops flowing. At this moment, the gate potential of the PMOS transistor 111 is substantially zero, and the potential at the source terminal thereof is about 1 V.

As a result, the voltage remaining in the floating capacity (not shown) of the LED element LED1 becomes about 1 V. Although the voltage decreases gradually due to a small leaking current, the voltage is maintained at 1 V until the forward voltage is applied upon driving the LEDs in a next operation. Accordingly, the LED element is driven along a luminescent output Po indicated with a projected line in FIG. 17, thereby making an initial rise time and a decline time of the luminescent output Po small.

Figure 12:
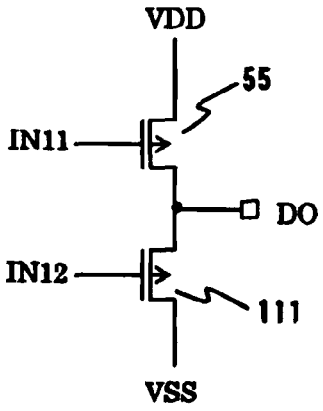
FIGS. 12(*a*) to 12(*c*) are circuit diagrams showing an operation of the drive circuit according to the second embodiment of the present invention, wherein FIG. 12(*a*) is a circuit diagram showing a PMOS transistor and a PMOS transistor, FIG. 12(*b*) is a sectional view showing the PMOS transistor and the PMOS transistor taken along gate terminals, source terminals, and drain terminals thereof, and FIG. 12(*c*) is an equivalent circuit diagram of the circuit diagram shown in FIG. 12(*a*)
Figure 12:
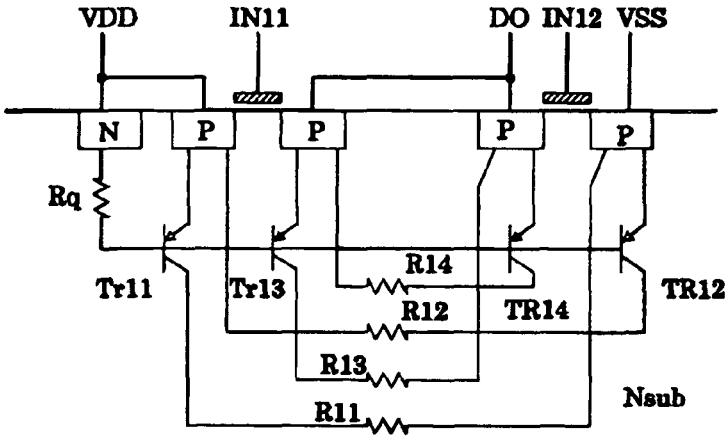
Figure 12:
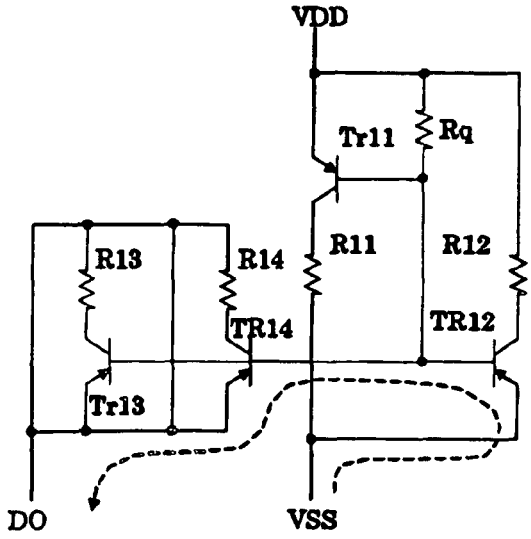
Figure 13:
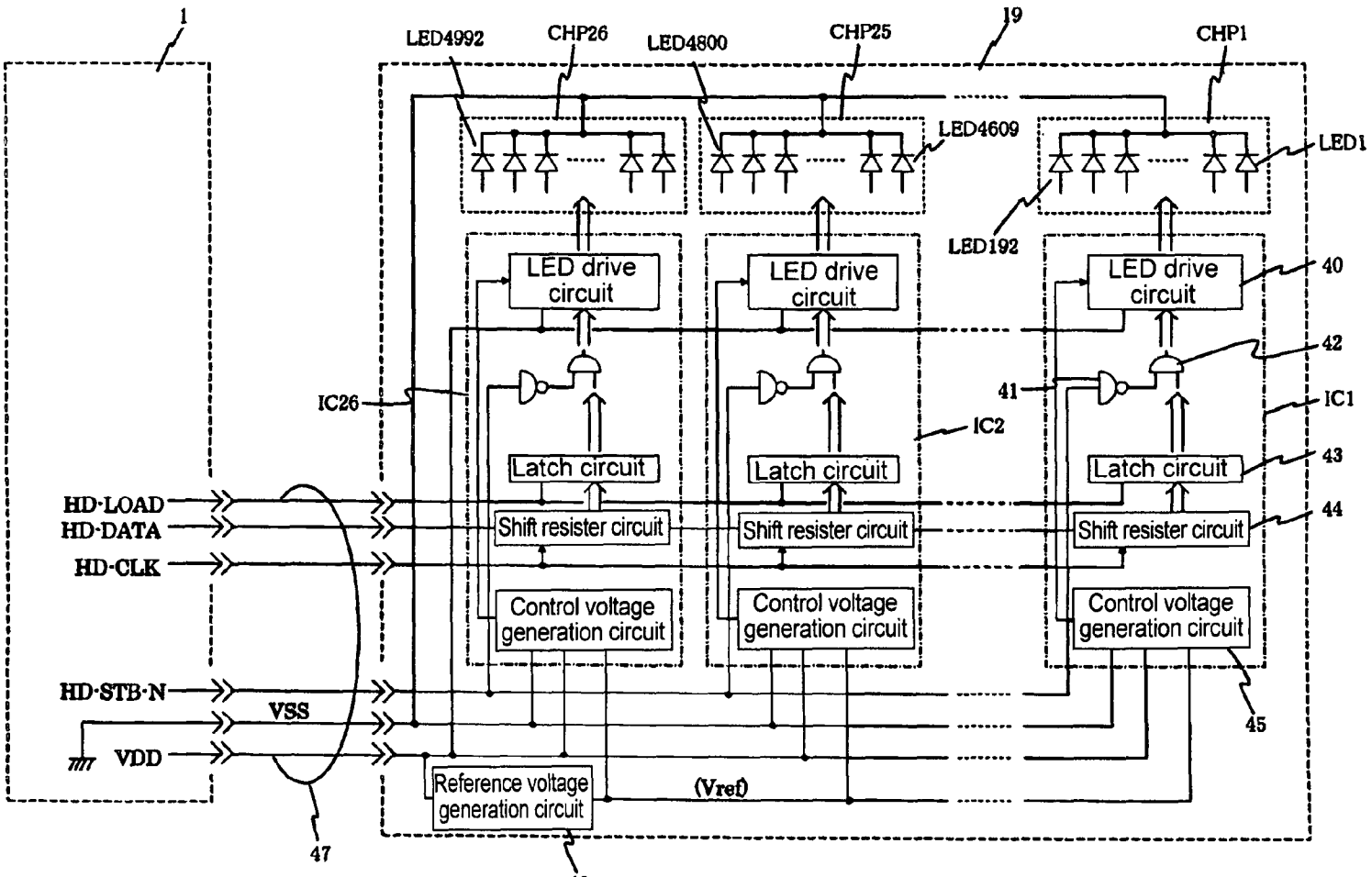
FIG. 13 CONVENTIONAL ART
FIG. 13 is a block diagram showing an LED head and a print control unit of a conventional electro-photography printer.
Figure 14:
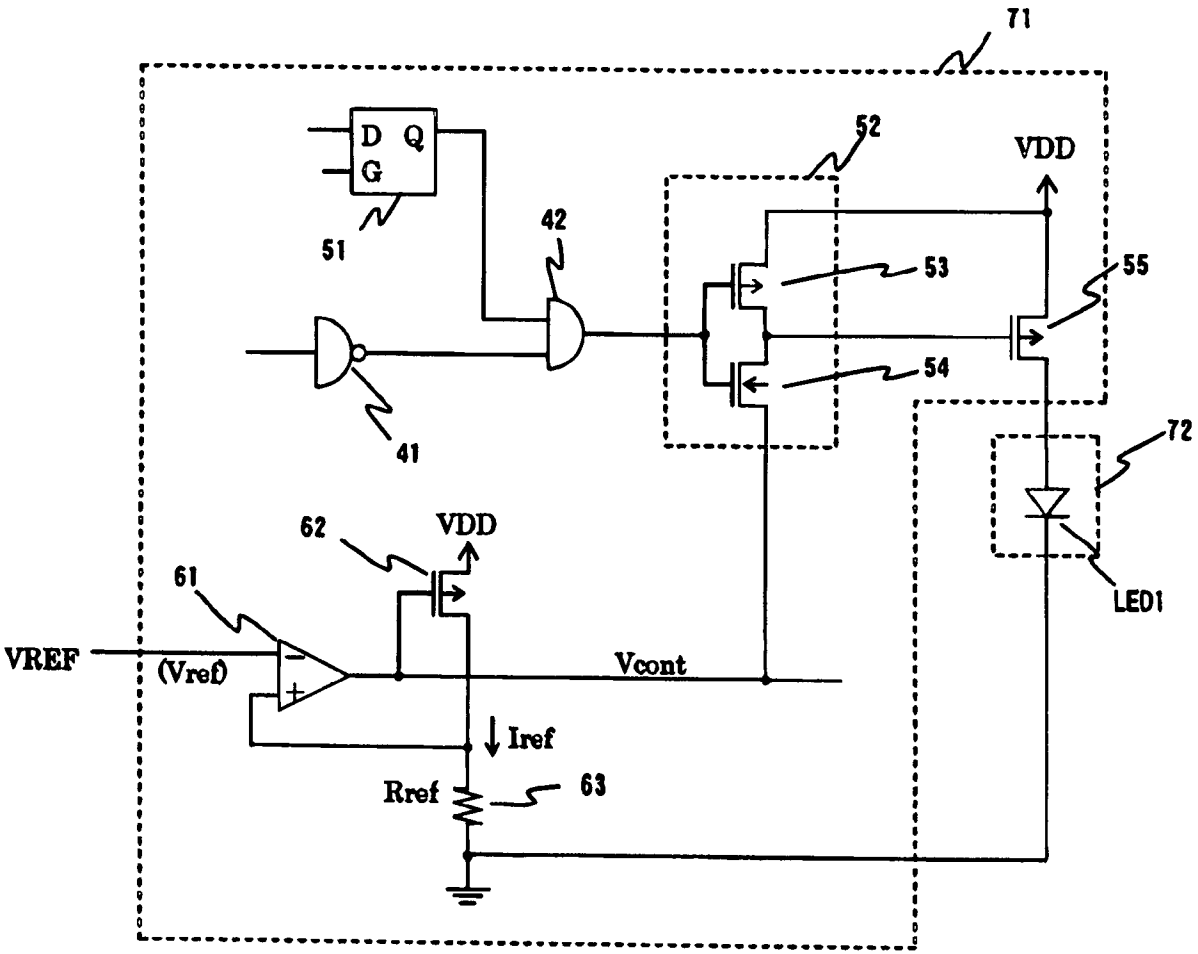
FIG. 14 CONVENTIONAL ART
FIG. 14 is a circuit diagram showing an LED drive circuit of a driver IC of the conventional electro-photography printer.

FIGS. 12(*a*) to 12(*c*) are circuit diagrams showing an operation of the drive circuit according to the second embodiment of the present invention. More specifically, FIG. 12(*a*) is a circuit diagram showing the PMOS transistor 55 and the PMOS transistor 111, FIG. 12(*b*) is a sectional view showing the PMOS transistor and the PMOS transistor taken along gate terminals, source terminals, and drain terminals thereof, and FIG. 12(*c*) is an equivalent circuit diagram of the circuit diagram shown in FIG. 12(*a*).

As shown in FIG. 12(*a*), the source terminal of the PMOS transistor 55 is connected to the power source VDD. The drain terminal of the PMOS transistor 55 is connected to the drain terminal of the PMOS transistor 111 and the output terminal DO of the driver IC. The drain terminal of the PMOS transistor 111 is connected to the ground VSS of the driver IC. The gate terminals of the PMOS transistor 55 and the PMOS transistor 111 are connected to abbreviated signals IN1 and IN2.

As shown in FIG. 12(*b*), a silicon wafer Nsub constituting the driver IC is formed of a member containing an N-type impurity. The gate terminals of the PMOS transistor 55 and the PMOS transistor 111 are indicated as hatched areas connected to the abbreviated signals IN1 and IN2. The source areas and the drain areas of the PMOS transistor 55 and the PMOS transistor 111 are arranged on both sides of the gate terminals as areas P with a P-type impurity introduced therein.

In the embodiment, PNP bio-polar transistors Tr11 to Tr14 are provided as parasite elements of the PMOS transistor 55 and the PMOS transistor 111.

In the embodiment, an emitter terminal of the PNP bio-polar transistor Tr11 is connected to the source terminal of the PMOS transistor 55. An emitter terminal of the PNP bio-polar transistor Tr13 is connected to the drain terminal of the PMOS transistor 55. Base terminals of the PNP bio-polar transistors Tr11 and Tr13 are connected to the silicon wafer Nsub, and are connected to an N-type area for a substrate contact through a resistor Rq of the silicon wafer Nsub, and further to the power source VDD.

In the embodiment, an emitter terminal of the PNP bio-polar transistor Tr12 is connected to the drain terminal of the PMOS transistor 111. An emitter terminal of the PNP bio-polar transistor Tr14 is connected to the source terminal of the PMOS transistor 111. Base terminals of the PNP bio-polar transistors Tr12 and Tr14 are connected to the silicon wafer Nsub, and are connected to the N-type area for the substrate contact through the resistor Rp of the silicon wafer Nsub, and further to the power source VDD.

In the embodiment, resistors R11 to R14 are provided as collector resistors of the PNP bio-polar transistors Tr11 to Tr14. One end portions of the resistors R11 to R14 are connected to collector terminals of the PNP bio-polar transistors Tr11 to Tr14. The other end portions of the resistors R11 and R13 are connected to the ground VSS and the output terminal DO, respectively. The other end portions of the resistors R12 and R14 are connected to the power source VDD and the ground VSS, respectively.

In the embodiment, it is possible to prevent the latch up phenomenon with the following mechanism. As described above, the destructive factor called the latch up phenomenon may occur in the element having the CMOS structure. The output circuit is formed of only the PMOS transistor, thereby preventing the latch up phenomenon.

It is supposed that a current flows in a hidden line arrow direction in the equivalent circuit diagram shown in FIG. 12(*c*). At this moment, a voltage is applied such that the current flows from the ground VSS to the output terminal DO. Accordingly, a voltage is applied in a forward direction between the base terminal and the emitter terminal of the PNP bi-polar transistor Tr12.

In the embodiment, the PNP bi-polar transistors Tr13 and Tr14 are connected to the base terminal of the PNP transistor Tr12. Accordingly, a voltage is applied in a reverse direction between the base terminal and the emitter terminal of the PNP bi-polar transistor Tr12, so that the PNP bi-polar transistors Tr13 and Tr14 are not turned on.

When all of the LEDs stop emitting light, the reverse induced voltage is discharged through the following process. As described above, in the embodiment, the PMOS transistors 55 and 111 are provided as shown in FIG. 11. Accordingly, the diode 112 and 113 are generated as the parasite elements thereof such that the cathode terminals thereof are connected to the power source VDD.

When all of the LEDs stop emitting light, the reverse induced voltage is generated in the inductance component 106 of the connection cable 31. As described above, when all of the LEDs emit light, the total current of about 15 A flows through the ground GND, i.e., the inductance component 106. When the current stops flowing upon the instruction to turn off the LEDs, the reverse induced voltage is generated at the both end portions of the inductance component 106. Accordingly, the current flows in the solid line arrow direction, so that the LED drive current continues.

The current flows from one end portion of the inductance 106 through a connection point between the ground GND and the ground VSS of the print control unit 21 to the VSS cable of the connection cable 31. Then, the current flows in the forward direction through the LED1 and the PMOS transistor 55 through the parasite diode 113 in the driver IC 71 (a model component of the base terminal and the emitter terminal of the transistor Tr12 in FIG. 12(*c*)), and returns to the other end portion of the inductance 106.

Through the process described above, the magnetic energy accumulated in the inductance 106 is discharged. Accordingly, the turning off operation of the LEDs is slightly delayed, but still faster than that of the conventional drive circuit.

As described above, in the embodiment, it is possible to improve quality of the LED head and increase an operational speed upon a printing operation. In the drive circuit shown in FIG. 11, the ground of the LEDs is separated from the ground VSS of the driver IC. Further, in addition to the PMOS transistor 55 in the drive circuit, the PMOS transistor 111 is provided for discharging charges accumulated in the capacity between the anode terminal and the cathode terminal of the PMOS transistor upon turning off the LEDs.

Accordingly, it is possible to prevent a false operation of the LED head due to a voltage decrease generated by a resistance component of the connection cable 31 upon turning off the LED or a variance in a print density upon a printing operation. Further, even when the reverse induced voltage is generated in the inductance component 106 of the connection cable 31 upon turning off the LEDs, it is possible to prevent the latch up phenomenon in the output circuit of the driver IC, thereby preventing damage on the driver IC 71 and improving reliability of the driver IC 71.

Further, in the embodiment, the current path is provided for discharging charges accumulated in the capacity between the anode terminal and the cathode terminal of the LED upon tuning off the LED. Accordingly, it is possible to turn off the LED in a short period of time. Further, when the LEDs are turned off, charges accumulated in the capacity between the anode terminal and the cathode terminal of the LED are not completely discharged. Accordingly, it is possible to maintain a specific potential for a next operation during the LEDs do not emit light, thereby making an initial rise time of the luminescent output small upon turning on the LEDs and obtaining a fast printing operation of the printer.

In the first and second embodiments, the drive circuit is applied to the LED head in the electro-photography printer using the LEDs as the light source, and may be applicable to an organic LED head using organic LEDs as a light source. Further, the drive circuit may be applicable for driving an array of heating resistors disposed in a thermal printer, and an array of display units disposed in a display device.

The disclosure of Japanese Patent Application No. 2007-233955, filed on Sep. 10, 2007, is incorporated in the application by reference.

While the invention has been explained with reference to the specific embodiments of the invention, the explanation is illustrative and the invention is limited only by the appended claims.

What is claimed is:

1. A drive circuit for selectively driving a driven element, comprising:

a first MOS (Metal Oxide Semiconductor) transistor connected to the driven element for driving the driven element; and a discharge section connected to the first MOS transistor and the driven element for discharging charges, which are accumulated in the driven element when the driven element is turned on, when the driven element is turned off, said discharge section being formed of a second MOS transistor.

2. The drive circuit according to claim 1, wherein said first MOS transistor includes a first ground route disposed separately from a second ground route of the driven element.

3. The drive circuit according to claim 2, further comprising a connection cable for connecting the first ground route to the second ground route.

4. The drive circuit according to claim 3, further comprising a diode disposed between the connection cable and at least one of the first ground route and the second ground route.

5. The drive circuit according to claim 1, wherein each of said first MOS transistor and said second MOS transistor is formed of a p-channel MOS transistor.

6. An LED (Light Emitting Diode) head comprising an LED as the driven element and the drive circuit according to claim 1.

7. The LED head according to claim 6, wherein said first MOS transistor includes a first ground route disposed separately from a second ground route of the driven element.

8. The LED head according to claim 7, further comprising a connection cable for connecting the first ground route to the second ground route.

9. The LED head according to claim 8, further comprising a diode disposed between the connection cable and at least one of the first ground route and the second ground route.

10. An image forming apparatus comprising the drive circuit according to claim 1.

11. The image forming apparatus according to claim 10, wherein said first MOS transistor includes a first ground route disposed separately from a second ground route of the driven element.

12. The image forming apparatus according to claim 11, further comprising a connection cable for connecting the first ground route to the second ground route.

13. The image forming apparatus according to claim 12, further comprising a diode disposed between the connection cable and at least one of the first ground route and the second ground route.

14. An LED head comprising:

a plurality of LEDs arranged in an array pattern;

a plurality of drive circuits for selectively driving the LEDs, each of said drive circuits including a first MOS transistor connected to each of the LEDs for driving each of the LEDs; and a plurality of discharge sections corresponding to the LEDs for discharging charges, which are accumulated in the LEDs when the drive circuits turn on the LEDs, when the drive circuits turn off the LEDs, each of said discharge sections being connected to the first MOS transistor and each of the LEDs and formed of a second MOS transistor.

15. The LED head according to claim 14, wherein said first MOS transistor includes a first ground route disposed separately from a second ground route of the LEDs.

16. The LED head according to claim 15, further comprising a connection cable for connecting the first ground route to the second ground route.

17. The LED head according to claim 16, further comprising a diode disposed between the connection cable and at least one of the first ground route and the second ground route.

18. An image forming apparatus comprising the LED head according to claim 14.

19. An image forming apparatus comprising the LED head according to claim 17.

20. The drive circuit according to claim 4, wherein said diode is formed of a Shottky diode.

21. The drive circuit according to claim 1, wherein said first MOS transistor is formed of a p-channel MOS transistor and said second MOS transistor is formed of a n-channel MOS transistor.

22. The drive circuit according to claim 1, further comprising an inverter circuit formed of a third MOS transistor and a fourth MOS transistor, said first MOS transistor being connected between the inverter circuit and the driven element.

* * * * *